US006642653B1

(12) United States Patent
Hirano et al.

(10) Patent No.: US 6,642,653 B1
(45) Date of Patent: Nov. 4, 2003

(54) PLASMA DISPLAY APPARATUS WITH PHOTO MASK APERTURES

(75) Inventors: Naoto Hirano, Tokyo (JP); Hirokazu Tateno, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/497,919

(22) Filed: Feb. 4, 2000

(30) Foreign Application Priority Data

Feb. 4, 1999 (JP) ..... 11-027195

(51) Int. Cl.[7] ..... H01J 17/49

(52) U.S. Cl. ..... 313/582; 313/584; 313/585; 313/484; 313/485; 313/486; 313/495; 445/24; 349/106

(58) Field of Search ..... 313/582, 583, 313/584, 491, 492, 494, 581, 585, 484, 485, 495; 349/106; 445/24

(56) References Cited

U.S. PATENT DOCUMENTS 5,601,468 A * 2/1997 Fujii et al. ..... 427/68
6,072,272 A * 6/2000 Rumbaugh ..... 313/470
6,088,011 A * 7/2000 Lee et al. ..... 345/60
6,194,826 B1 * 2/2001 Satou et al. ..... 313/485
6,297,590 B1 * 10/2001 Nanto et al. ..... 313/581
6,310,672 B1 * 10/2001 Koike et al. ..... 349/106
6,333,597 B1 * 12/2001 Mitomo ..... 313/489

FOREIGN PATENT DOCUMENTS

JP 7-226945 8/1995 ..... H04N/9/30
JP 8-190869 7/1996 ..... H01J/17/49
JP 9-61614 3/1997 ..... G02B/5/20
JP 2001084915 A * 3/2001 ..... H01J/11/02

* cited by examiner

*Primary Examiner*—Nimeshkumar D. Patel
*Assistant Examiner*—Sikha Roy
(74) *Attorney, Agent, or Firm*—Choate, Hall & Stewart

(57) ABSTRACT

Disclosed is a plasma display apparatus comprising: discharge spaces of red which emit lights of red; discharge spaces of green which emit lights of green; discharge spaces of blue which emit lights of blue; and photo masks which are formed and arranged in order that an aperture of each of the discharge spaces of red may be wider than an aperture of each of the discharge spaces of green in area and an aperture of each of the discharge spaces of blue may be wider than the aperture of each of the discharge spaces of red in area.

19 Claims, 24 Drawing Sheets

PLASMA DISPLAY APPARATUS WITH PHOTO MASK APERTURES

BACKGROUND OF THE INVENTION

1. Field of the Invention

The present invention relates to an AC surface discharge type of matrix plasma display apparatus in which ultraviolet lights caused by discharge are applied to fluoresce to excite the fluoresce to emits lights in a space which corresponds to a colour of red, green, or blue and is formed by arranging partitions between substrates and particularly, relates to the AC surface discharge type of matrix plasma display apparatus in which color purity of white color emission is improved by suitably adjusting balance among the brightness of red, the brightness of green, and the brightness of blue which are simultaneously emitted. The AC surface discharge type of matrix plasma display apparatus is suitable for full-colour display.

2. Description of the Prior Art

FIG. 37 is a cross sectional view showing a structure of a typical conventional AC surface discharge type of plasma display panel (PDP) and FIGS. 38–40 are plan views or front views showing structures of principal parts thereof.

Referring to FIG. 37, pairs 7 of a scan electrode and a common electrode are disposed on front glass substrate 6 in row direction. Each of the pairs 7 is composed of beltlike transparent conductive sheets. Usually, metal electrodes not shown are connected to the scan electrodes and common electrodes in order to reduce resistance thereof. Further, transparent insulator layer 8 composed of a low melting point glass and a transparent protection layer which is not shown and composed of magnesium oxides are stacked in this order.

In order to improve contrast, vertical beltlike photo mask 9*a* as shown in FIG. 38, horizontal beltlike photo mask 9*b* as shown in FIG. 39, or lattice photo mask 9*c* is disposed in or out of transparent insulator layer 8 as photo mask 9. Each of photo masks 9*a*–9*c* has uniform width. Color filters may be disposed on photo masks 9*a*–9*c* in order to improve the tone of color as disclosed in JPA 9-61614.

On the other hand, data electrodes 2 composed of metal sheets are disposed on rear glass substrate 1 in column direction. Further, white insulator layer 3 composed of a low melting point glass containing titanium oxide particles and alumina particles is stacked on rear glass substrate 1 and data electrodes 2. Still further, partitions 4 composed of low melting point glasses are stacked on white insulator 3 in column direction. Each of spaces partitioned by partitions 4 has fluoresce 5*a*, 5*b*, or 5*c* which correspond to color emission of red, green, or blue.

Front grass substrate 6 and rear grass substrate 1 are stuck together so that pairs 7 of the scan electrode and common electrode intersect data electrodes 2. A pixel of a single color of red, green, or blue is formed at each of the intersecting points. Ultraviolet lights caused from discharge gas 10 which is enclosed inside and composed of rare gas excite fluoresce 5*a*, 5*b*, and 5*c* to emit lights, whereby a picture display is executed.

The first prior art is JPA 7-226945 entitled "Color Plasma Display" in which a discharge space is narrowed to increase the number of appearing pixels and thereby to realize pseudo high definition of a picture without lowering emission efficiency. In the first prior art, each of the discharge cells of green is divided into two pieces so that the horizontal size of discharge cells of green becomes a half of the horizontal size of discharge cells of red and blue. Every second discharge cell of green in horizontal direction is shifted along vertical direction by a half of the vertical size of the cell.

The second prior art is JPA 8-190869 entitled "Plasma Display Panel" in which partitions are so designed that the area of blue or red becomes wider than the area of green, whereby the adjustment of color becomes easy.

In case that usual fluoresce is used for a plasma display panel, color purity deteriorates when pixels of red, green, and blue simultaneously emit lights or a color of white is displayed, because of imbalance of the brightness among red, green, and blue. In order to avoid the deterioration of color purity, discharge spaces of pixels are so adjusted that the discharge space of red becomes larger than the discharge space of green and the discharge space of blue becomes larger than the discharge space of red, or a drive circuit is so designed to generate drive signals which make the brightness of green low or brightness of blue high.

However, the method of adjusting discharge spaces of pixels has a disadvantage that improvement in drive method and fine design technique which are difficult to realize are required, because discharge characteristics of red, green, and blue become different from each other. The method of improving the drive signals has a disadvantage that the tone of color deteriorates when the level of a video signal rises, because the brightness of green which has been intentionally suppressed gradually rises.

SUMMARY OF THE INVENTION

In order to overcome the aforementioned disadvantages, the present invention has been made and accordingly, has an object to provide a plasma display panel apparatus in which shapes of photo masks with various and simple structures make an aperture area corresponding to a discharge space of red be wider than an aperture area corresponding to a discharge space of green, and an aperture area corresponding to a discharge space of blue be wider than an aperture area corresponding to a discharge space of red without complicating pixel structures and a drive method; color purity of white color emission is improved owing to appropriateness of balance of the brightness among red, green, and blue when pixels of red, green, and blue simultaneously emit lights; and deterioration of picture quality due to color shift is suppressed.

According to an aspect of the present invention, there is provided a plasma display apparatus comprising: discharge spaces of red which emit lights of red; discharge spaces of green which emit lights of green; discharge spaces of blue which emit lights of blue; and photo masks which are formed and arranged in order that an aperture of each of the discharge spaces of red may be wider than an aperture of each of the discharge spaces of green in area and an aperture of each of the discharge spaces of blue may be wider than the aperture of each of the discharge spaces of red in area.

The photo masks may comprise vertical photo masks. A width of each of vertical photo masks may vary in dependence on whether a corresponding discharge space is the discharge spaces of red, the discharge space of green, or the discharge space of blue. The vertical photo masks may include projections. The projections may be disposed on the discharge spaces of green and the discharge spaces of red, and the projections disposed on the discharge spaces of green may be wider than the projections disposed on the discharge space of red in area.

The photo masks may comprise horizontal photo masks. The horizontal photo masks may include projections. The projections may be disposed on the discharge spaces of green and the discharge spaces of red, and the projections disposed on the discharge spaces of green may be wider than the projections disposed on the discharge space of red in area.

The photo masks may comprise vertical photo masks and horizontal photo masks. A width of each of vertical photo masks may vary in dependence whether a corresponding discharge space is said discharge spaces of red, said discharge space of green, or said discharge space of blue. The vertical photo masks and the horizontal photo masks may be combined with one another. The vertical photo masks include projections. The projections may be disposed on the discharge spaces of green and the discharge spaces of red, and the projections disposed on the discharge spaces of green may be wider than the projections disposed on the discharge space of red in area. The horizontal photo masks include projections. The projections may be disposed on the discharge spaces of green and the discharge spaces of red, and the projections disposed on the discharge spaces of green may be wider than the projections disposed on the discharge space of red in area.

The photo masks may comprise discrete photo masks. The discrete photo masks may be disposed on the discharge spaces of green and the discharge spaces of red, and the discrete photo masks disposed on the discharge spaces of green may be wider than the discrete photo masks disposed on the discharge space of red in area.

The photo masks may comprise zigzag photo masks. The zigzag photo masks may be disposed on the discharge spaces of green and the discharge spaces of red, and the zigzag photo masks disposed on the discharge spaces of green may be wider than the zigzag photo masks disposed on the discharge space of red in area.

The photo masks may comprise diagonal photo masks. The diagonal photo masks may be disposed on the discharge spaces of green and the discharge spaces of red, and the diagonal photo masks disposed on the discharge spaces of green may be wider than the photo masks disposed on the discharge space of red in area.

These and other objects, features and advantages of the present invention will become more apparent in the light of the following detailed description of the best mode embodiments thereof, as illustrated in the accompanying drawings.

DETAILED DESCRIPTION OF THE PREFERRED EMBODIMENT

Figure 1:
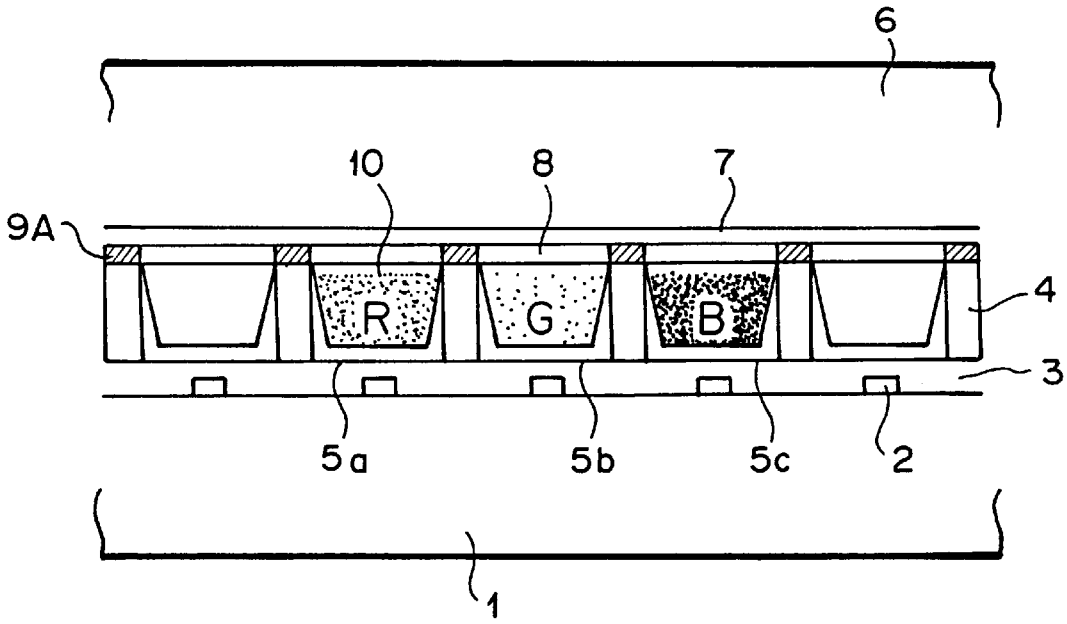
FIG. 1 is a cross sectional view showing a basic structure of an AC surface discharge type of plasma display apparatus according to embodiments of the present invention.

Preferred modes of embodiment according to the present invention will be described with reference to the accompanying drawings.

Referring to FIGS. 1 to 4, in the plasma display panel of the embodiment of the present invention, data electrodes 2 composed of metal sheets are arranged on rear glass substrate 1 in column direction. Further, white insulator layer 3 composed of a low melting point glass including titanium oxide particles and alumina particles is stacked on rear glass substrate 1. Still further, partitions 4 composed of low melting point glasses are stacked on insulator layer 3 in column direction. Each of spaces partitioned by partitions 4 has fluoresce 5*a*, 5*b*, or 5*c* which is excited to emit lights of color of red, green, or blue.

Pairs 7 of a scan electrode and a common electrode composed of beltlike transparent conductive sheets are arranged on front glass substrate 6. Metal electrodes not shown are connected to scan electrodes and common electrodes in order to lower resistance. Further, transparent insulator layer 8 composed of a low melting point glass and a transparent protection layer which is not shown and composed of magnesium oxides are stacked in this order. Photo mask 9A is disposed in or out of transparent insulator 8 in order to improve contrast.

Front glass substrate 6 and rear glass substrate 1 are stuck together so that pairs 7 of the scan electrode and common electrode intersect data electrodes 2. A pixel of a single color of red, green, or blue is formed at each of the intersecting points. Ultraviolet lights caused from discharge gas 10 which is enclosed inside and composed of rare gas excite fluoresces 5*a*–5*c* to emit lights, whereby a picture display is executed.

Figure 2:
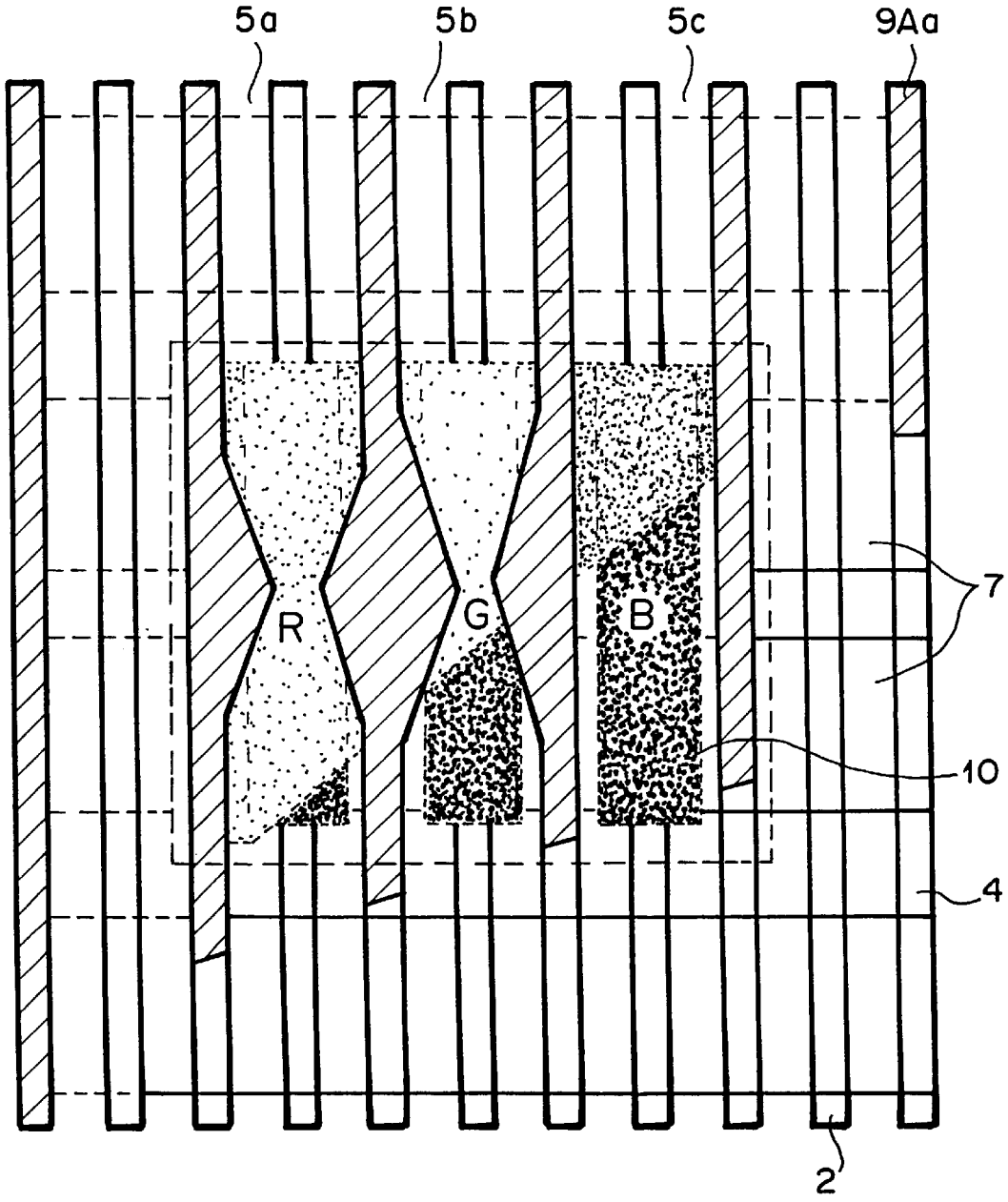
FIG. 2 is a plan view showing a principle structure of the AC surface discharge type of plasma display apparatus according to a first embodiment of the present invention.

Referring to FIG. 2 showing the first embodiment, some of but not all of photo masks 9Aa of vertical beltlike shape include various projections. FIG. 2 shows a triangular projections, but FIGS. 11 to 14 show other shapes of projections. The projections make an aperture area corresponding to a discharge space of red be wider than an aperture area corresponding to a discharge space of green, and an aperture area corresponding to a discharge space of blue be wider than the aperture area corresponding to the discharge space of red.

Figure 3:
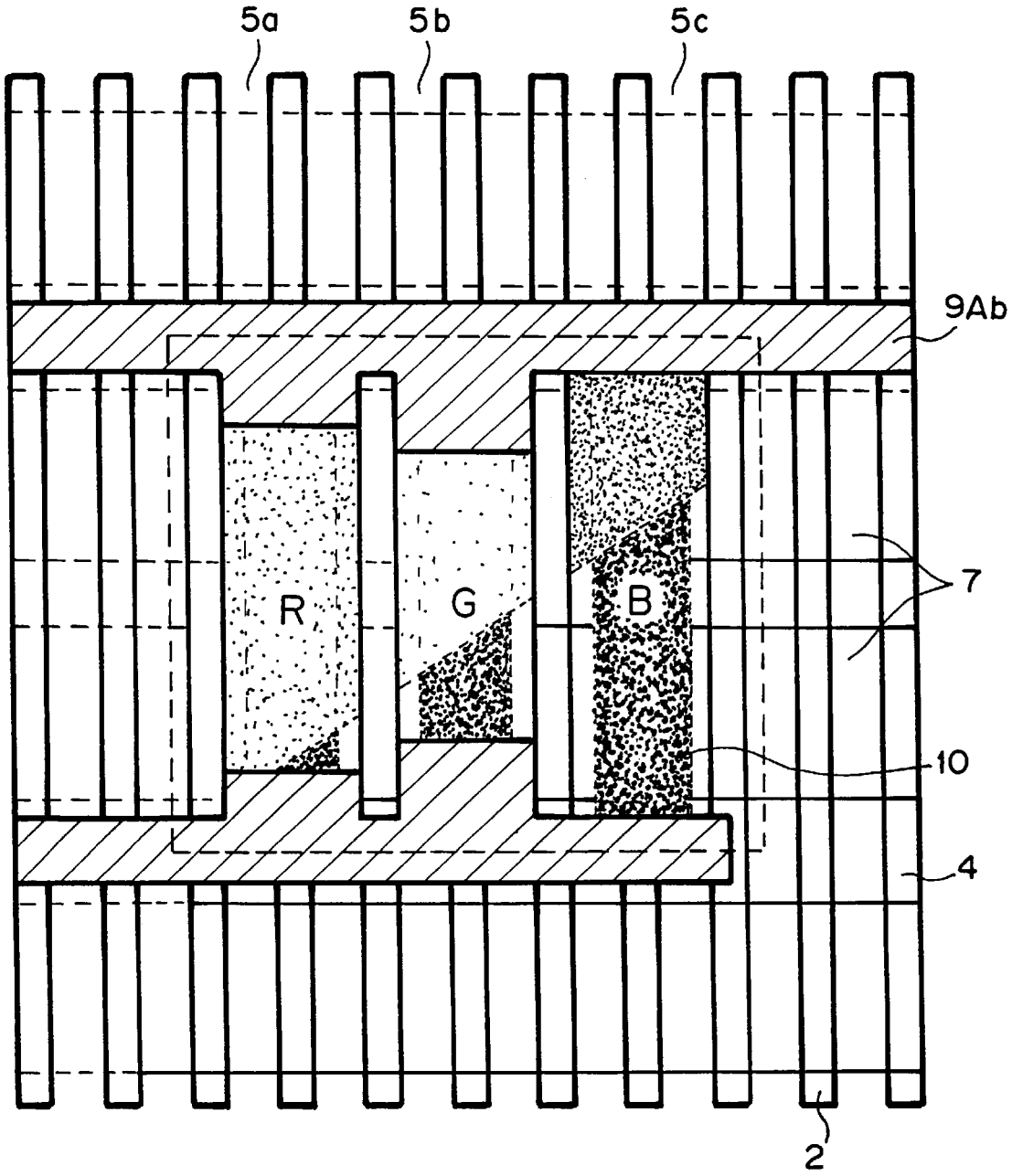
FIG. 3 is a plan view showing another principle structure of the AC surface discharge type of plasma display apparatus according to a second embodiment of the present invention.

Referring to FIG. 3 showing the second embodiment, photo masks 9Ab of horizontal beltlike shape include various projections. FIG. 3 shows a rectangular projections, but FIGS. 15 to 24 show other shapes of projections. The projections make an aperture area corresponding to a discharge space of red be wider than an aperture area corresponding to a discharge space of green, and an aperture area corresponding to a discharge space of blue be wider than the aperture area corresponding to the discharge space of red.

Figure 4:
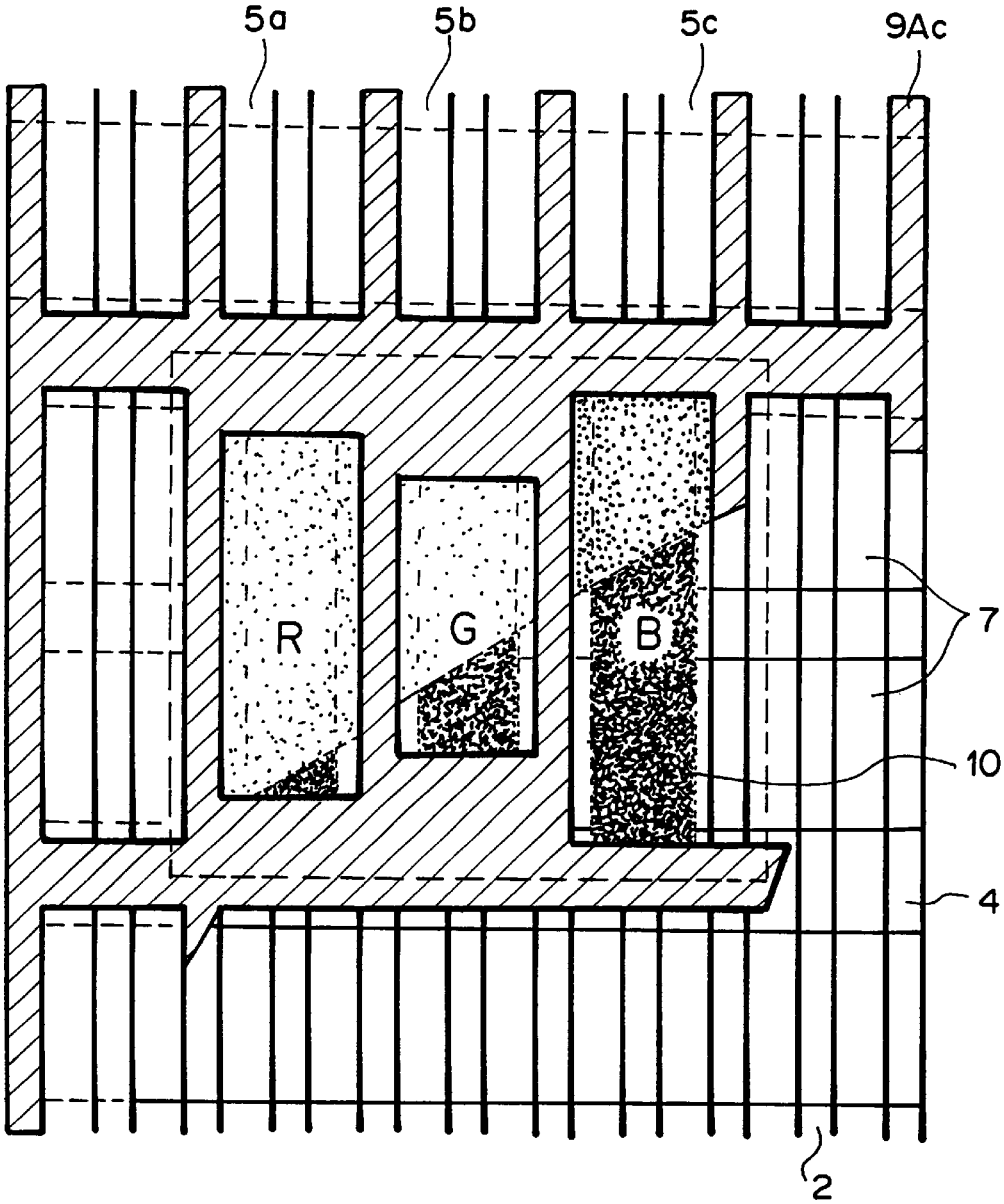
FIG. 4 is a plan view showing a still another principle structure of the AC surface discharge type of plasma display apparatus according to a third embodiment of the present invention.

Referring to FIG. 4 showing the third embodiment, photo masks 9Ac of lattice shape include various projections. FIG. 4 shows a rectangular projections, but FIGS. 25 to 30 show other shapes of projections. The projections make an aperture area corresponding to a discharge space of red be wider than an aperture area corresponding to a discharge space of green, and an aperture area corresponding to a discharge space of blue be wider than the aperture area corresponding to the discharge space of red.

Plan view areas of spaces of pixels defined by partitions are uniform among red, green, and blue. Color filters may be disposed on photo masks 9Aa, 9Ab, and 9Ac in order to improve the tone of color.

The first to tenth examples explained below correspond to the first embodiment.

Figure 5:
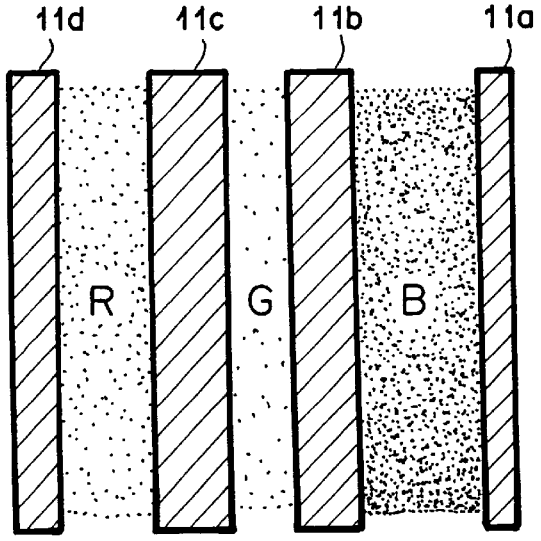
FIG. 5 is a plan view showing a principle structure of the AC surface discharge type of plasma display apparatus according to a first example of the present invention.

Referring to FIG. 5 showing the first example, photo masks 11*a*–11*d* which are of vertical beltlike shape and different from each other in width are disposed in order to make an aperture area corresponding to a discharge space of red be wider than an aperture area corresponding to a discharge space of green, and an aperture area corresponding to a discharge space of blue be wider than the aperture area corresponding to the discharge space of red. The width of photo mask 11*a* is most narrow, the width of photo mask 11*d* is wider than that of photo mask 11*a*, the width of photo mask 11*b* is wider than that of photo mask 11*d*, and the width of photo mask 11*c* is wider than that of photo ask 11*b*.

As a result, the brightness of fluoresces are obtained in the order of blue, red, and green. Therefore, the brightness of red, the brightness of green, and the brightness of blue coordinate each other, and purity of white color emission when pixels of red, green, and blue are simultaneously excited to emit lights is improved. In this case, there is no necessity to adjust plan view areas of spaces of pixels defined by partitions to adjust the areas in the order of blue, red, and green. That is, there is no necessity to introduce fine design technique in order to cope with difference in discharge characteristics among pixels of red, green, and blue. In addition, there is necessity to introduce a drive method by which the brightness of green is lowered or the brightness of blue is enhanced. That is, there is no necessity to improve the drive method. Further, the tone of color is hard to deteriorate when the level of a video signal rises, because there is no necessity to intentionally suppress the brightness of green.

Figure 6:
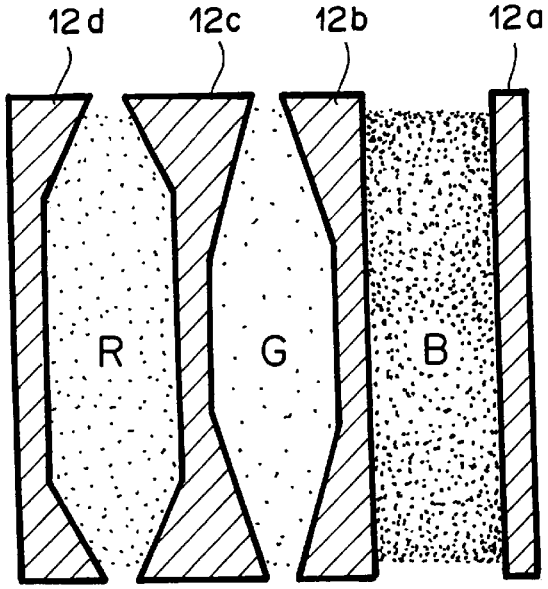
FIG. 6 is a plan view showing a principle structure of the AC surface discharge type of plasma display apparatus according to a second example of the present invention.

Referring to FIG. 6 showing the second example, photo masks 12*a*–12*d* of vertical beltlike shape are disposed at regular intervals. In addition, photo masks 12*b* and 12*c* have triangular projections facing each other at upper and lower portions on a discharge space of green. Further, photo masks 12*c* and 12*d* have triangular projections facing each other at upper and lower portions on a discharge space of red. The area masked by photo masks 12*b* and 12*c* on the discharge space of green is wider than the area masked by photo masks 12*c* and 12*d* on the discharge space of red.

In the second example, arranging photo masks 12*a*–12*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The second example takes the same effects as the first example.

Figure 7:
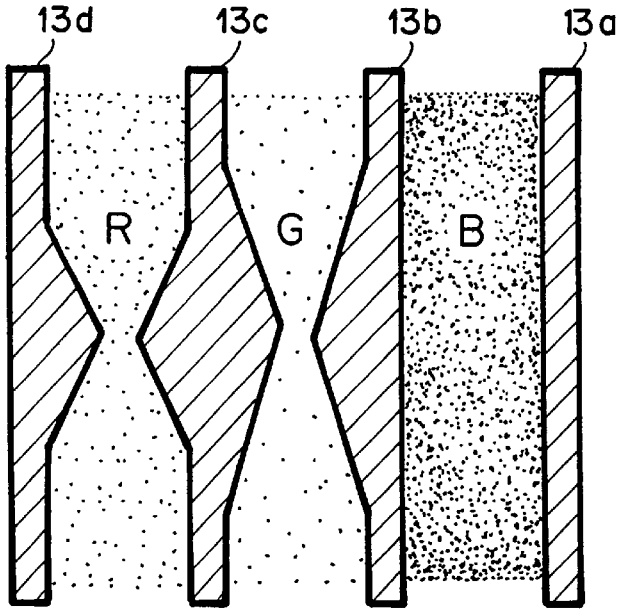
FIG. 7 is a plan view showing a principle structure of the AC surface discharge type of plasma display apparatus according to a third example of the present invention.

Referring to FIG. 7 showing the third example, photo masks 13*a*–13*d* of vertical beltlike shape are disposed at regular intervals. In addition, photo masks 13*b* and 13*c* have triangular projections facing each other at a middle portion on a discharge space of green. Further, photo masks 13*c* and 13*d* have triangular projections facing each other at a middle portion on a discharge space of red. The area masked by photo masks 13*b* and 13*c* on the discharge space of green is wider than the area masked by photo masks 13*c* and 13*d* on the discharge space of red.

In the third example, arranging photo masks 13*a*–13*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The third example takes the same effects as the first example.

Figure 8:
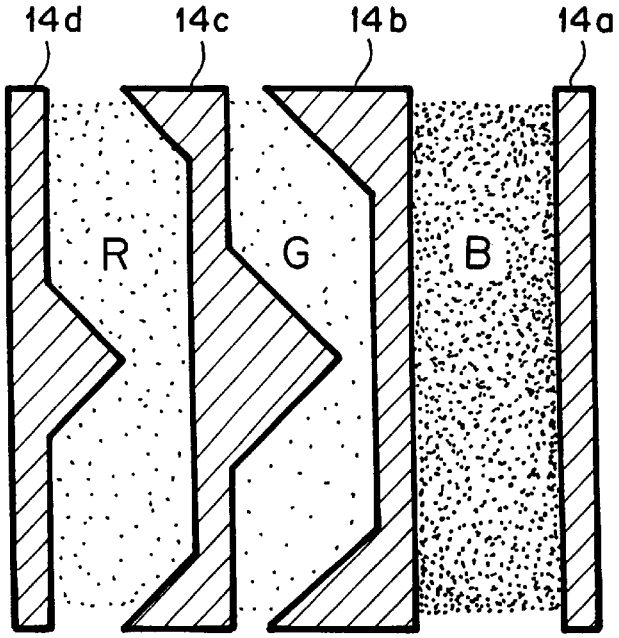
FIG. 8 is a plan view showing a principle structure of the AC surface discharge type of plasma display apparatus according to a fourth example of the present invention.

Referring to FIG. 8 showing the fourth example, photo masks 14*a*–14*d* vertical beltlike shape are disposed at regular intervals. In addition, photo ask 14*b* has triangular projections at upper and lower portions on a discharge space of green and photo mask 14*c* has a triangular projection at a middle portion on the discharge space of green. Further, photo mask 14*c* has triangular projections at upper and lower portions on a discharge space of red and photo mask 14*d* has a triangular projection at a middle portion on the discharge space of red. The area masked by photo masks 14*b* and 14*c* on the discharge space of green is wider than the area masked by photo masks 14*c* and 14*d* on the discharge space of red.

In the fourth example, arranging photo masks 14*a*–14*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The fourth example takes the same effects as the first example.

Figure 9:
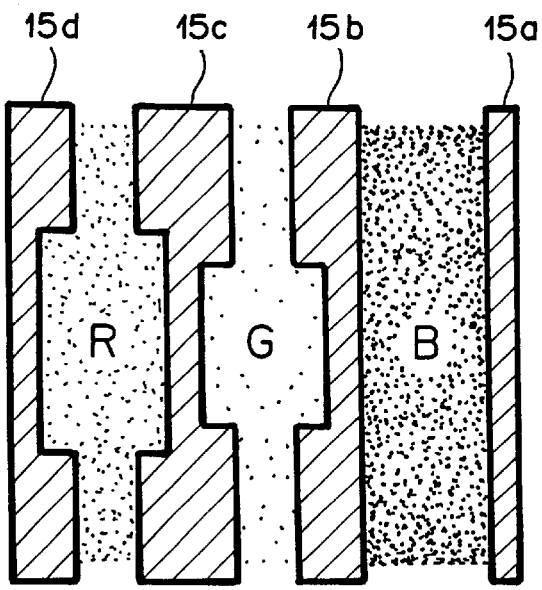
FIG. 9 is a plan view showing a principle structure of the AC surface discharge type of plasma display apparatus according to a fifth example of the present invention.

Referring to FIG. 9 showing the fifth example, photo masks 15*a*–15*d* of vertical beltlike shape are disposed at regular intervals. In addition, photo masks 15*b* and 15*c* have rectangular projections facing each other at upper and lower portions on a discharge space of green. Further, photo masks 15*c* and 15*d* have rectangular projections facing each other at upper and lower portions on a discharge space of red. The area masked by photo masks 15*b* and 15*c* on the discharge space of green is wider than the area masked by photo masks 15*c* and 15*d* on the discharge space of red. The fifth example is the same as the second example except for the shape of projections.

In the fifth example, arranging photo masks 15*a*–15*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The fifth example takes the same effects as the first example.

Figure 10:
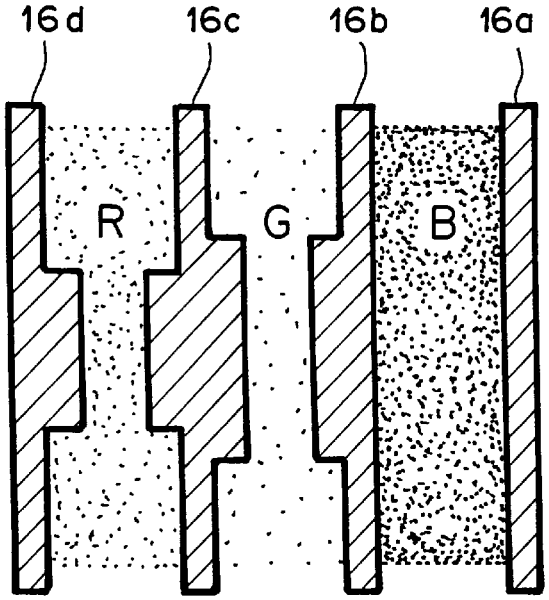
FIG. 10 is a plan view showing a principle structure of the AC surface discharge type of plasma display apparatus according to a sixth example of the present invention.

Referring to FIG. 10 showing the sixth example, photo masks 16*a*–16*d* of vertical beltlike shape are disposed at regular intervals. In addition, photo masks 16*b* and 16*c* have rectangular projections facing each other at a middle portion on a discharge space of green. Further, photo masks 16*c* and 16*d* have triangular projections facing each other at a middle portion on a discharge space of red. The area masked by photo masks 16*b* and 16*c* on the discharge space of green is wider than the area masked by photo masks 16*c* and 16*d* on the discharge space of red. The sixth example is the same as the third example except for the shape of projections.

In the sixth example, arranging photo masks 16*a*–16*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The sixth example takes the same effects as the first example.

Figure 11:
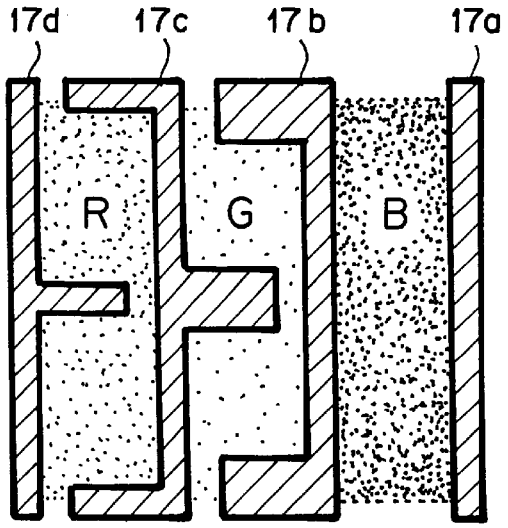
FIG. 11 is a plan view showing a principle structure of the AC surface discharge type of plasma display apparatus according to a seventh example of the present invention.

Referring to FIG. 11 showing the seventh example, photo masks 17*a*–17*d* of vertical beltlike shape are disposed at regular intervals. In addition, photo mask 17*b* has rectangular projections at upper and lower portions on a discharge space of green and photo mask 17*c* has a rectangular projection at a middle portion on the discharge space of green. Further, photo mask 17*c* has rectangular projections at upper and lower portions on a discharge space of red and photo mask 17*d* has a rectangular projection at a middle portion on the discharge space of red. The area masked by photo masks 17*b* and 17*c* on the discharge space of green is wider than the area masked by photo masks 17*c* and 17*d* on the discharge space of red. The seventh example is the same as the second example except for the shape of projections.

In the seventh example, arranging photo masks 17*a*–17*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The seventh example takes the same effects as the first example.

Figure 12:
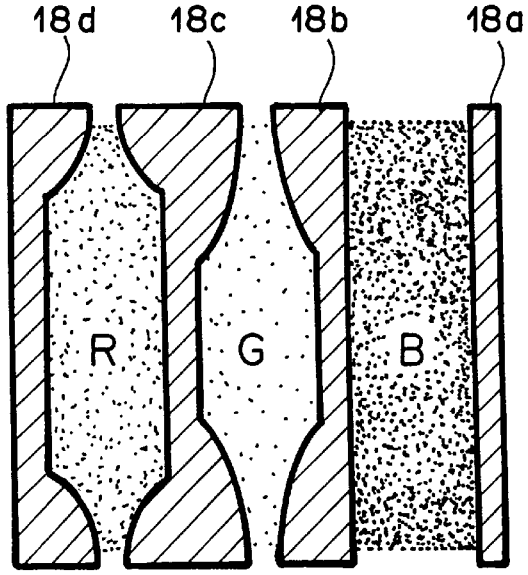
FIG. 12 is a plan view showing a principle structure of the AC surface discharge type of plasma display apparatus according to a eighth example of the present invention.

Referring to FIG. 12 showing the eighth example, photo masks 18*a*–18*d* of vertical beltlike shape are disposed at regular intervals. In addition, photo masks 18*b* and 18*c* have convex projections facing each other at upper and lower portions on a discharge space of green. Further, photo masks 18*c* and 18*d* have convex projections facing each other at upper and lower portions on a discharge space of red. The area masked by photo masks 18*b* and 18*c* on the discharge space of green is wider than the area masked by photo masks 18*c* and 18*d* on the discharge space of red. The eighth example is the same as the second example except for the shape of projections.

In the eighth example, arranging photo masks 18*a*–18*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The eighth example takes the same effects as the first example.

Figure 13:
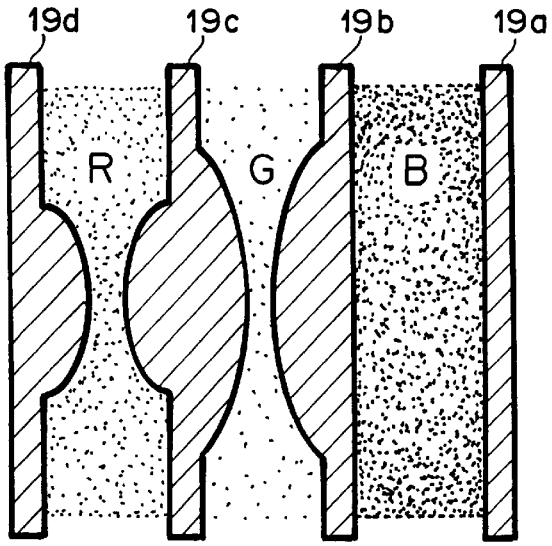
FIG. 13 is a plan view showing a principle structure of the AC surface discharge type of plasma display apparatus according to a ninth example of the present invention.

Referring to FIG. 13 showing the ninth example, photo masks 19*a*–19*d* of vertical beltlike shape are disposed at regular intervals. In addition, photo masks 19*b* and 19*c* have convex projections facing each other at a middle portion on a discharge space of green. Further, photo masks 19*c* and 19*d* have convex projections facing each other at a middle portion on a discharge space of red. The area masked by photo masks 19*b* and 19*c* on the discharge space of green is wider than the area masked by photo masks 19*c* and 19*d* on the discharge space of red. The ninth example is the same as the third example except for the shape of projections.

In the ninth example, arranging photo masks 19*a*–19*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The ninth example takes the same effects as the first example.

Figure 14:
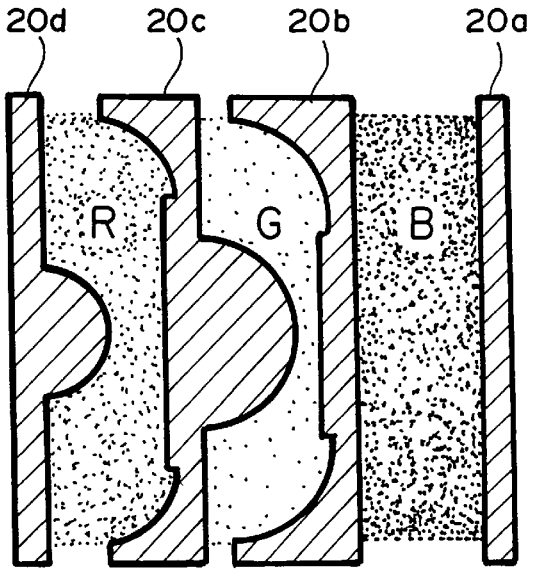
FIG. 14 is a plan view showing a principle structure of the AC surface discharge type of plasma display apparatus according to a tenth example of the present invention.

Referring to FIG. 14 showing the tenth example, photo masks 20*a*–20*d* of vertical beltlike shape are disposed at regular intervals. In addition, photo mask 20*b* has concave projections at upper and lower portions on a discharge space of green and photo mask 20*c* has a convex projection at a middle portion on the discharge space of green. Further, photo mask 20*c* has concave projections at upper and lower portions on a discharge space of red and photo mask 20*d* has a convex projection at a middle portion on the discharge space of red. The area masked by photo masks 20*b* and 20*c* on the discharge space of green is wider than the area masked by photo masks 20*c* and 20*d* on the discharge space of red. The tenth example is the same as the second example except for the shape of projections.

In the tenth example, arranging photo masks 20*a*–20*d* of vertical beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The tenth example takes the same effects as the first example.

The eleventh to twentieth examples explained below correspond to the second embodiment.

Figure 15:
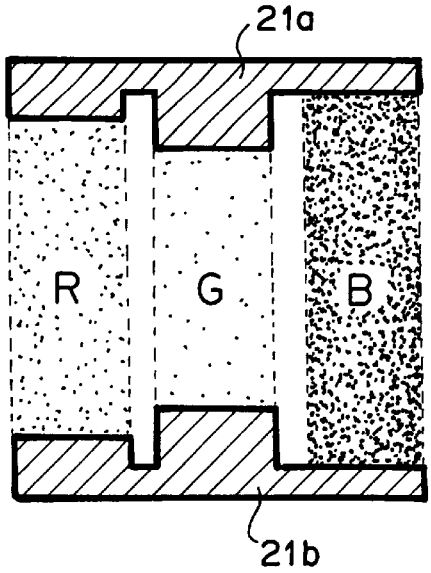
FIG. 15 is a plan view showing a principle structure of the AC surface discharge type of plasma display apparatus according to a eleventh example of the present invention.

Referring to FIG. 15 showing the eleventh example, photo masks 21*a* and 21*b* of horizontal beltlike shape are disposed. In addition, photo masks 21*a* and 21*b* have facing rectangular projections at upper and lower portions on a discharge space of green, respectively. Further, photo masks 21*a* and 21*b* have facing rectangular projections at upper and lower portions on a discharge space of red, respectively. The area masked by photo masks 21*a* and 21*b* on the discharge space of green is wider than the area masked by photo masks 21*a* and 21*b* on the discharge space of red.

In the eleventh example, arranging photo masks 21*a* and 21*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The eleventh example takes the same effects as the first example.

Figure 16:
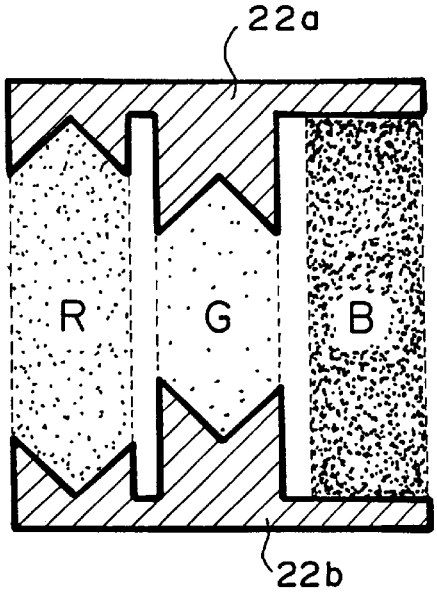
FIG. 16 is a plan view showing a principle structure of the AC surface discharge type of plasma display apparatus according to a twelfth example of the present invention.

Referring to FIG. 16 showing the twelfth example which is a modification of the eleventh example, photo masks 22*a* and 22*b* of horizontal beltlike shape are disposed. In addition, photo masks 22*a* and 22*b* have facing rectangular projections with V-shaped concaves at upper and lower portions on a discharge space of green, respectively. Further, photo masks 22*a* and 22*b* have facing rectangular projections with V-shaped concaves at upper and lower portions on a discharge space of red, respectively. The area masked by photo masks 22*a* and 22*b* on the discharge space of green is wider than the area masked by photo masks 22*a* and 22*b* on the discharge space of red.

In the twelfth example, arranging photo masks 22*a* and 22*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The twelfth example takes the same effects as the first example.

Figure 17:
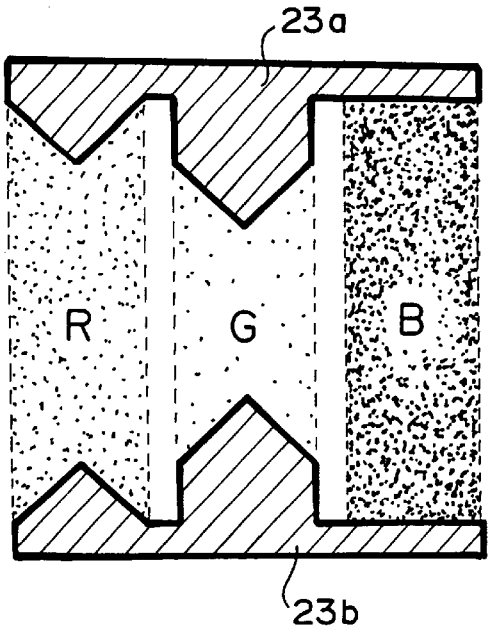
FIG. 17 is a plan view showing a principle structure of the AC surface discharge type of plasma display apparatus according to a thirteenth example of the present invention.

Referring to FIG. 17 showing the thirteenth example which is a modification of the eleventh example, photo masks 23*a* and 23*b* of horizontal beltlike shape are disposed. In addition, photo masks 23*a* and 23*b* have facing rectangular projections with V-shaped convexes at upper and lower portions on a discharge space of green, respectively. Further, photo masks 23*a* and 23*b* have facing rectangular projections with V-shaped convexes at upper and lower portions on a discharge space of red, respectively. The area masked by photo masks 23*a* and 23*b* on the discharge space of green is wider than the area masked by photo masks 23*a* and 23*b* on the discharge space of red.

In the thirteenth example, arranging photo masks 23*a* and 23*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The thirteenth example takes the same effects as the first example.

Figure 18:
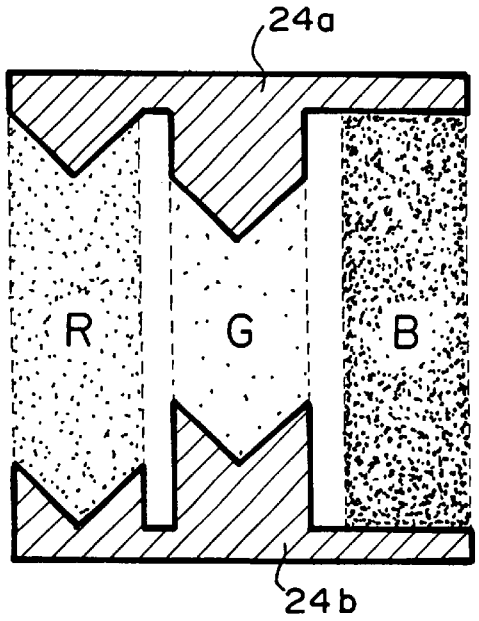
FIG. 18 is a plan view showing a principle structure of the AC surface discharge type of plasma display apparatus according to a fourteenth example of the present invention.

Referring to FIG. 18 showing the fourteenth example which is a modification of the eleventh example, photo masks 24*a* and 24*b* of horizontal beltlike shape are disposed. In addition, photo mask 24*a* has a rectangular projection with a V-shaped convex at an upper portion on a discharge space of green and photo mask 24*b* has a rectangular projection with a V-shaped concave at a lower portion on the discharge space of green. The projections of photo masks 24*a* and 24*b* on the discharge space of green face each other. Further, photo mask 24*a* has a rectangular projection with a V-shaped convex at an upper portion on a discharge space of red and photo mask 24*b* has a rectangular projection with a V-shaped concave at a lower portion on the discharge space of red. The projections of photo masks 24*a* and 24*b* on the discharge space of red face each other. The area masked by photo masks 24*a* and 24*b* on the discharge space of green is wider than the area masked by photo masks 24*a* and 24*b* on the discharge space of red.

In the fourteenth example, arranging photo masks 24*a* and 24*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The fourteenth example takes the same effects as the first example.

Figure 19:
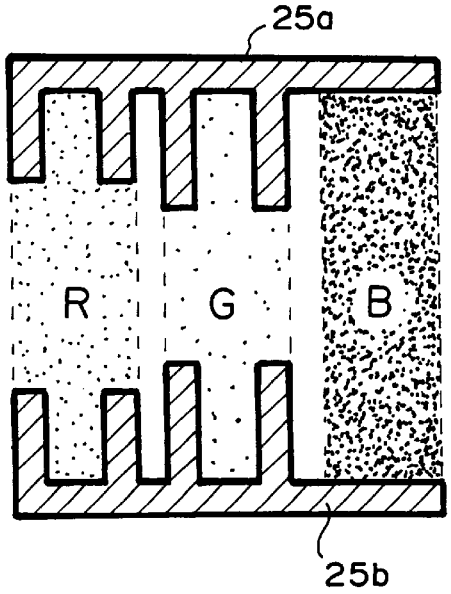
FIG. 19 is a plan view showing a principle structure of the AC surface discharge type of plasma display apparatus according to a fifteenth example of the present invention.

Referring to FIG. 19 showing the fifteenth example which is a modification of the eleventh example, photo masks 25*a* and 25*b* of horizontal beltlike shape are disposed. In addition, photo masks 25*a* and 25*b* have facing pairs of rectangular projections at upper and lower portions on a discharge space of green, respectively. Further, photo masks 25*a* and 25*b* have facing pairs of rectangular projections at upper and lower portions on a discharge space of red, respectively. The area masked by photo masks 25*a* and 25*b* on the discharge space of green is wider than the area masked by photo masks 25*a* and 25*b* on the discharge space of red.

In the fifteenth example, arranging photo masks 25*a* and 25*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The fifteenth example takes the same effects as the first example.

Figure 20:
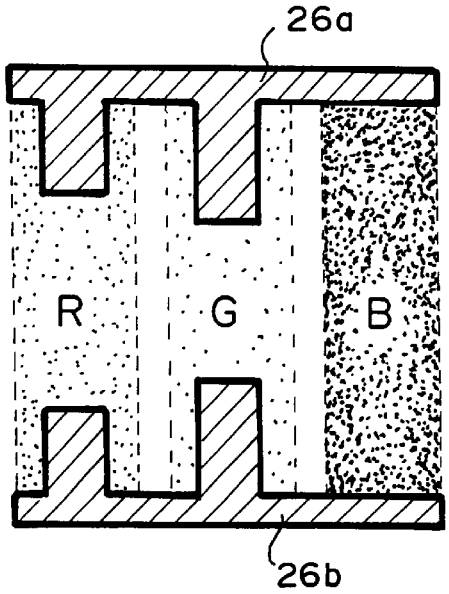
FIG. 20 is a plan view showing a principle structure of the AC surface discharge type of plasma display apparatus according to a sixteenth example of the present invention.

Referring to FIG. 20 showing the sixteenth example which is a modification of the eleventh example, photo masks 26*a* and 26*b* of horizontal beltlike shape are disposed. In addition, photo masks 26*a* and 26*b* have facing rectangular projections at upper and lower portions on a discharge space of green, respectively. Further, photo masks 26*a* and 26*b* have facing rectangular projections at upper and lower portions on a discharge space of red, respectively. The projections of photo masks 26*a* and 26*b* are narrower and longer than those of photo masks 21*a* and 21*b* of the eleventh example. The area masked by photo masks 26*a* and 26*b* on the discharge space of green is wider than the area masked by photo masks 26*a* and 26*b* on the discharge space of red.

In the sixteenth example, arranging photo masks 26*a* and 26*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The sixteenth example takes the same effects as the first example.

Figure 21:
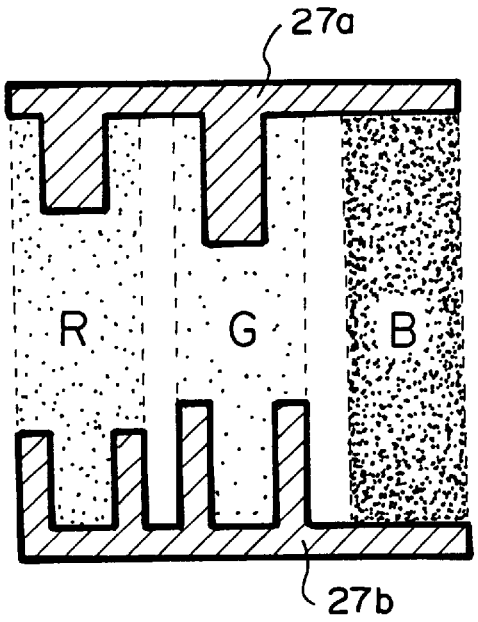
FIG. 21 is a plan view showing a principle structure of the AC surface discharge type of plasma display apparatus according to a seventeenth example of the present invention.

Referring to FIG. 21 showing the seventeenth example which is a combination of the fifteenth and sixteenth examples, photo masks 27*a* and 27*b* of horizontal beltlike shape are disposed. In addition, photo mask 27*a* has a rectangular projection which is the same as the fifteenth example at upper portion on a discharge space of green and photo mask 27*b* has a pair of rectangular projections which is the same as the sixteenth example at lower portion on the discharge space of green. Further, photo mask 27*a* has a rectangular projection which is the same as the fifteenth example at upper portion on a discharge space of red and photo mask 27*b* has a pair of rectangular projections which is the same as the sixteenth example at lower portion on the discharge space of red. The area masked by photo masks 27*a* and 27*b* on the discharge space of green is wider than the area masked by photo masks 27*a* and 27*b* on the discharge space of red.

In the seventeenth example, arranging photo masks 27*a* and 27*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The seventeenth example takes the same effects as the first example.

Figure 22:
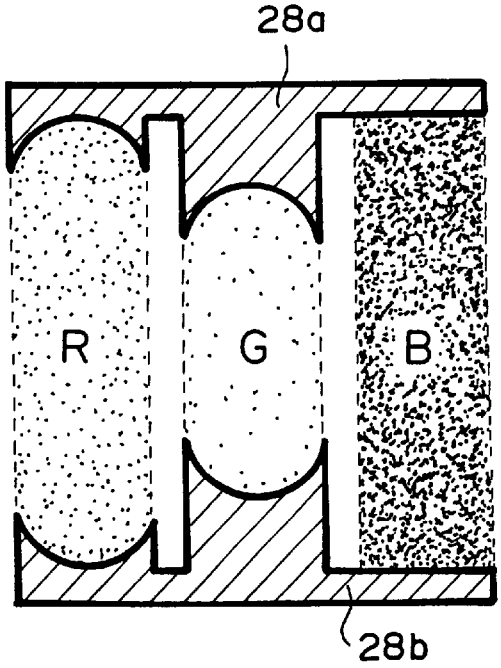
FIG. 22 is a plan view showing a principle structure of the AC surface discharge type of plasma display apparatus according to a eighteenth example of the present invention.

Referring to FIG. 22 showing the eighteenth example which is a modification of the eleventh example, photo masks 28*a* and 28*b* of horizontal beltlike shape are disposed. In addition, photo masks 28*a* and 28*b* have facing rectangular projections with round concaves at upper and lower portions on a discharge space of green, respectively. Further, photo masks 28*a* and 28*b* have facing rectangular projections with round concave at upper and lower portions on a discharge space of red, respectively. The area masked by photo masks 28*a* and 28*b* on the discharge space of green is wider than the area masked by photo masks 28*a* and 28*b* on the discharge space of red.

In the eighteenth example, arranging photo masks 28*a* and 29*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The eighteenth example takes the same effects as the first example.

Figure 23:
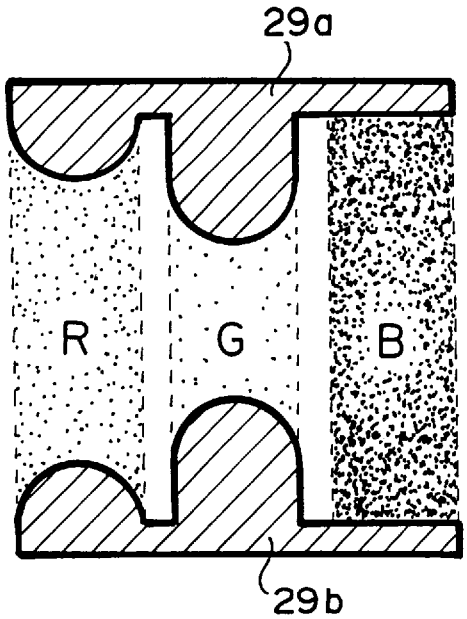
FIG. 23 is a plan view showing a principle structure of the AC surface discharge type of plasma display apparatus according to a nineteenth example of the present invention.

Referring to FIG. 23 showing the nineteenth example which is a modification of the eleventh example, photo masks 29*a* and 29*b* of horizontal beltlike shape are disposed. In addition, photo masks 29*a* and 29*b* have facing rectangular projections with round convexes at upper and lower portions on a discharge space of green, respectively. Further, photo masks 29*a* and 29*b* have facing rectangular projections with round convex at upper and lower portions on a discharge space of red, respectively. The area masked by photo masks 29*a* and 29*b* on the discharge space of green is wider than the area masked by photo masks 29*a* and 29*b* on the discharge space of red.

In the nineteenth example, arranging photo masks 29*a* and 29*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The nineteenth example takes the same effects as the first example.

Figure 24:
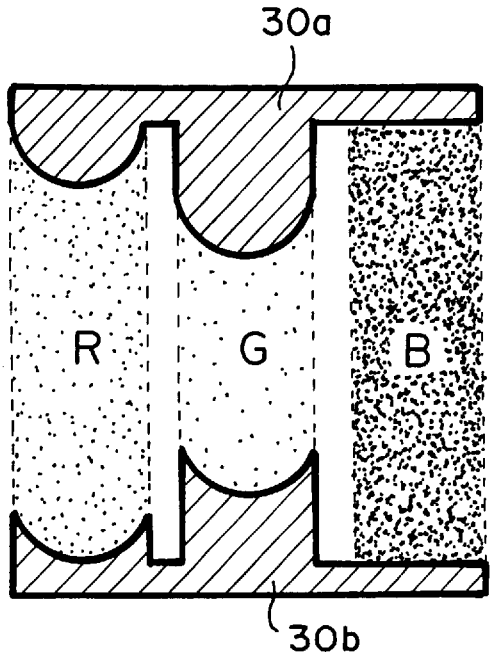
FIG. 24 is a plan view showing a principle structure of the AC surface discharge type of plasma display apparatus according to a twentieth example of the present invention.

Referring to FIG. 24 showing the twentieth example which is a modification of the eleventh example, photo masks 30*a* and 30*b* of horizontal beltlike shape are disposed. In addition, photo mask 30*a* has a rectangular projection with a round convex at an upper portion on a discharge space of green and photo mask 30*b* has a rectangular projection with a round concave at a lower portion on the discharge space of green. The projections of photo masks 30*a* and 30*b* on the discharge space of green face each other. Further, photo mask 30*a* has a rectangular projection with a round convex at an upper portion on a discharge space of red and photo mask 24*b* has a rectangular projection with a round concave at a lower portion on the discharge space of red. The projections of photo masks 30*a* and 30*b* on the discharge space of red face each other. The area masked by photo masks 30*a* and 30*b* on the discharge space of green is wider than the area masked by photo masks 30*a* and 30*b* on the discharge space of red.

In the twentieth example, arranging photo masks 30*a* and 30*b* of horizontal beltlike shape and forming the projections make an aperture area corresponding to the discharge space of red be wider than an aperture area corresponding to the discharge space of green, and an aperture area corresponding to a discharge space of blue be wider than the aperture area corresponding to the discharge space of red. The twentieth example takes the same effects as the first example.

The 21st to 30th examples explained below correspond to the third embodiment.

Figure 25:
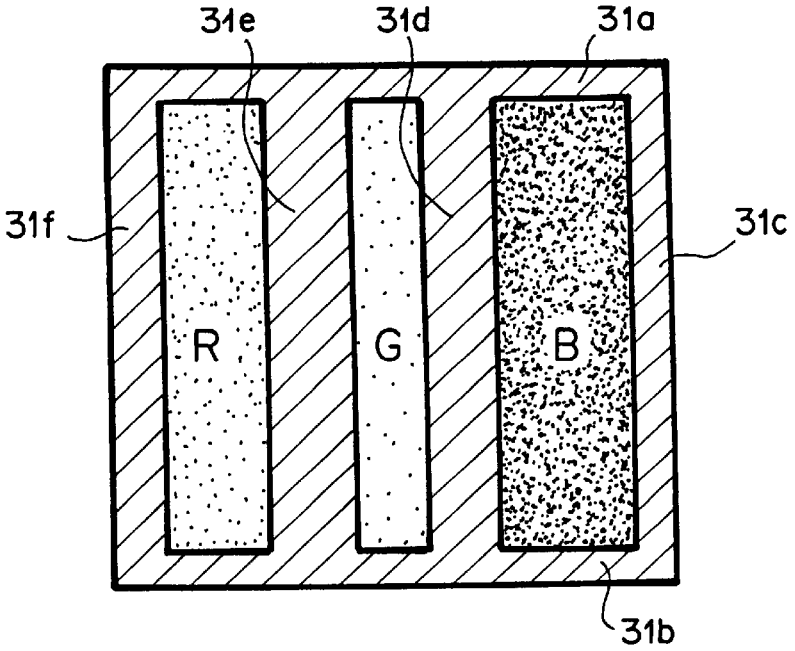
FIG. 25 is a plan view showing a principle structure of the AC surface discharge type of plasma display apparatus according to a 21st example of the present invention.

Referring to FIG. 25 showing the 21st example, photo masks 31*a* and 31*b* of horizontal beltlike shape and photo masks 31*c*–31*f* of vertical beltlike shape are disposed to surround each of discharge spaces corresponding to red, green, and blue. Photo masks 31*c*, 31*d*, 31*e*, and 31*f* are arranged at regular intervals. Among the width of photo masks 31*c*–31*f*, the width of photo mask 31*c* is most narrow, the width of photo mask 31*f* is wider than that of photo mask 31*c*, the width of photo mask 31*d* is wider than that of photo mask 31*c*, and the width of photo mask 31*e* is wider than that of photo mask 31*d*. The area masked by photo masks 31*d* and 31*e* on the discharge space of green is wider than the area masked by photo masks 31*e* and 31*f* on the discharge space of red.

In the 21st example, arranging photo masks 31*a*–31*f* and adjusting the width of photo masks 31*c*–31*f* make an aperture area corresponding to the discharge space of red be wider than an aperture area corresponding to the discharge space of green, and an aperture area corresponding to a discharge space of blue be wider than the aperture area corresponding to the discharge space of red. The 21st example takes the same effects as the first example.

Figure 26:
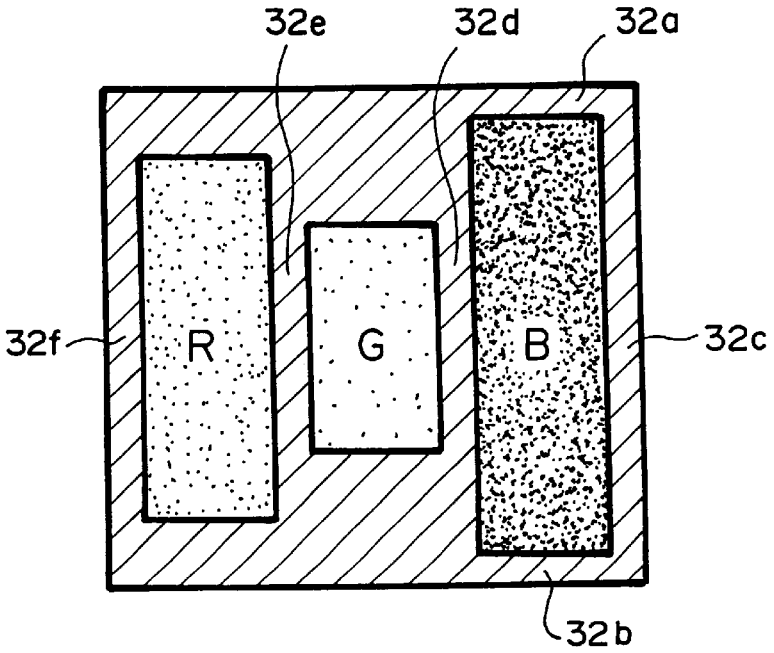
FIG. 26 is a plan view showing a principle structure of the AC surface discharge type of plasma display apparatus according to a 22nd example of the present invention.

Referring to FIG. 26 showing the 22nd example, photo masks 32*a* and 32*b* of horizontal beltlike shape and photo masks 32*c*–32*f* of vertical beltlike shape are disposed to surround each of discharge spaces corresponding to red, green, and blue. In addition, photo masks 32*a* and 32*b* have facing rectangular projections at upper and lower portions on a discharge space of green, respectively. Further, photo masks 32*a* and 32*b* have facing rectangular projections at upper and lower portions on a discharge space of red, respectively. The area masked by photo masks 32*a*, 32*b*, 32*d*, and 32*e* on the discharge space of green is wider than the area masked by photo masks 32*a*, 32*b*, 32*e*, and 32*f* on the discharge space of red.

In the 22nd example, arranging photo masks 32*a* and 32*b* of horizontal beltlike shape and photo masks 32*c*–32*f* of vertical beltlike shape, and forming the projections make an aperture area corresponding to the discharge space of red be wider than an aperture area corresponding to the discharge space of green, and an aperture area corresponding to a discharge space of blue be wider than the aperture area corresponding to the discharge space of red. The 22nd example takes the same effects as the first example.

Figure 27:
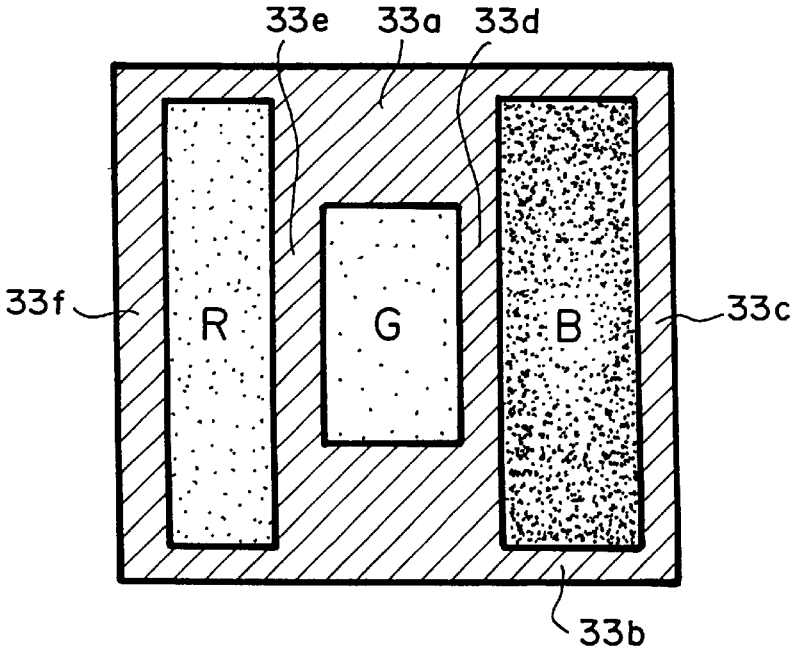
FIG. 27 is a plan view showing a principle structure of the AC surface discharge type of plasma display apparatus according to a 23rd example of the present invention.

Referring to FIG. 27 showing the 23rd example which is a modification of the 22nd example, photo masks 33*a* and 33*b* of horizontal beltlike shape and photo masks 33*c*–33*f* of vertical beltlike shape are disposed to surround each of discharge spaces corresponding to red, green, and blue. In addition, photo masks 33*a* and 33*b* have facing rectangular projections at upper and lower portions on a discharge space of green, respectively. Further, photo masks 33*a* and 33*b* have facing rectangular projections at upper and lower portions on a discharge space of red, respectively. Still further, photo masks 33*e* and 33*f* are wider than photmasks 33*c* and 33*d*. The area masked by photo masks 33*a*, 33*b*, 33*d*, and 33*e* on the discharge space of green is wider than the area masked by photo masks 33*a*, 33*b*, 33*e*, and 33*f* on the discharge space of red.

In the 23rd example, arranging photo masks 33*a* and 33*b* of horizontal beltlike shape and photo masks 33*c*–323 of vertical beltlike shape, forming the projections, and adjusting the width of photo mask 32*c*–32*f* make an aperture area corresponding to the discharge space of red be wider than an aperture area corresponding to the discharge space of green, and an aperture area corresponding to a discharge space of blue be wider than the aperture area corresponding to the discharge space of red. The 23rd example takes the same effects as the first example.

Figure 28:
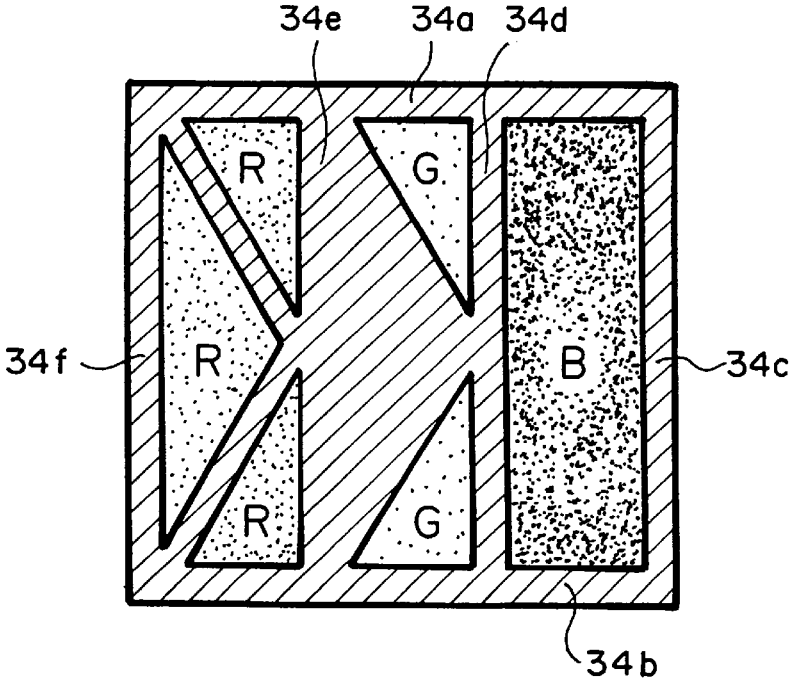
FIG. 28 is a plan view showing a principle structure of the AC surface discharge type of plasma display apparatus according to a 24th example of the present invention.

Referring to FIG. 28 showing the 24rd example, photo masks 34*a* and 34*b* of horizontal beltlike shape and photo masks 34*c*–34*f* of vertical beltlike shape are disposed to surround each of discharge spaces corresponding to red, green, and blue. In addition, photo mask 34*e* has a triangular projection reaching photo mask 34*d*. Further, photo mask 34*f* has a hollow triangular projection reaching photo mask 34*e*. The area masked by photo masks 34*a*, 34*b*, 34*d*, and 34*e* on the discharge space of green is wider than the area masked by photo masks 34*a*, 34*b*, 34*e*, and 34*f* on the discharge space of red.

In the 24th example, arranging photo masks 34*a* and 34*b* of horizontal beltlike shape and photo masks 34*c*–34*f* of vertical beltlike shape, and forming the projections make an aperture area corresponding to the discharge space of red be wider than the aperture area corresponding to a discharge space of green, and an aperture area corresponding to a discharge space of blue be wider than the aperture area corresponding to the discharge space of red. The 24th example takes the same effects as the first example.

Figure 29:
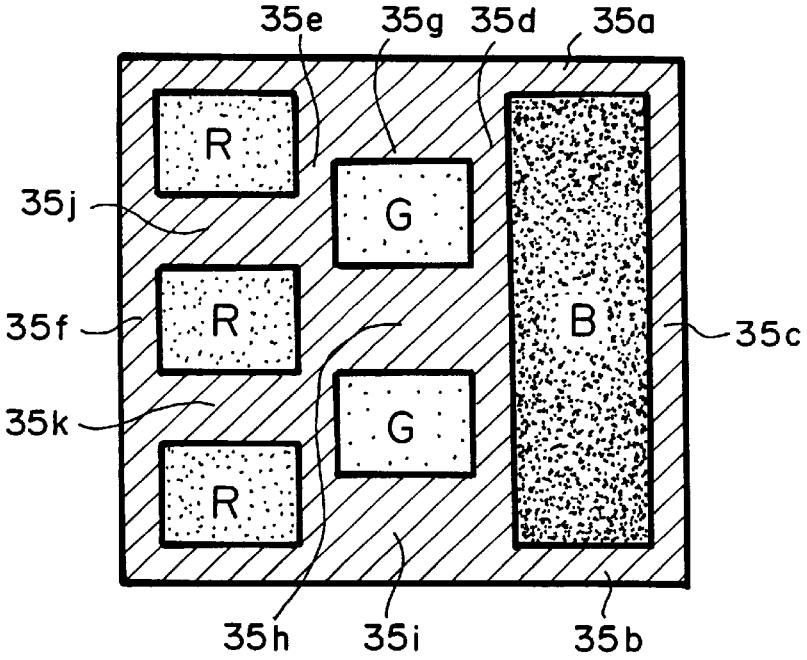
FIG. 29 is a plan view showing a principle structure of the AC surface discharge type of plasma display apparatus according to a 25th example of the present invention.

Referring to FIG. 29 showing the 25th example, photo masks 35*a* and 35*b* of horizontal beltlike shape and photo masks 35*c*–35*f* of vertical beltlike shape are disposed to surround each of discharge spaces corresponding to red, green, and blue. In addition, rectangular photo masks 35*g*–35*k* are disposed. Photo mask 35*g* bridges photo masks 35*a*, 35*d*, and 35*e*, photo mask 35*h* bridges photo masks 35*d* and 35*e*, photo mask 35*i* bridges photo masks 35*b*, 35*d*, and 35*e*, photo mask 35*j* bridges photo masks 35*e* and 35*f*, and photo mask 35*k* bridges photo masks 35*e* and 35*f*. The area masked by photo masks 35*a*, 35*b*, 35*d*, 35*e*, 35*g*, 35*h*, 35*i* on the discharge space of green is wider than the area masked by photo masks 35*a*, 35*b*, 35*e*, 35*f*, 35*j*, 35*k* on the discharge space of red.

In the 25th example, arranging photo masks 35*a* and 35*b* of horizontal beltlike shape, photo masks 35*c*–35*f* of vertical beltlike shape, and photo masks 35*g*–35*k* make an aperture area corresponding to the discharge space of red be wider than an aperture area corresponding to the discharge space of green, and an aperture area corresponding to a discharge space of blue be wider than the aperture area corresponding to the discharge space of red. The 25th example takes the same effects as the first example.

Figure 30:
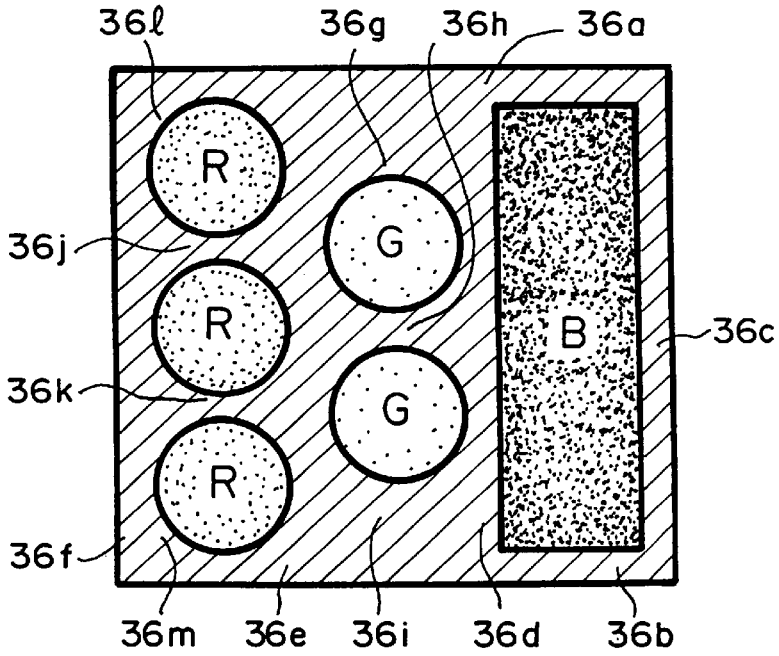
FIG. 30 is a plan view showing a principle structure of the AC surface discharge type of plasma display apparatus according to a 26th example of the present invention.

Referring to FIG. 30 showing the 26th example, photo masks 36*a* and 36*b* of horizontal beltlike shape and photo masks 36*c*–36*f* of vertical beltlike shape are disposed to surround each of discharge spaces corresponding to red, green, and blue. In addition, photo masks 36*g*–36*m* are disposed. Photo mask 36*g* bridges photo masks 36*a*, 36*d*, and 36*e*, photo mask 36*h* bridges photo masks 36*d* and 36*e*, photo mask 36*i* bridges photo masks 36*b*, 36*d*, and 36*e*, photo mask 36*j* bridges photo masks 36*e* and 36*f*, photo mask 36*k* bridges photo masks 36*e* and 36*f*, photo mask 36*l* bridges photo masks 36*a*, 36*e*, and 36*f*, and photo mask 36*m* bridges photo mask 36*b*, 36*e*, and 36*f*. Photo masks 36*g* and 36*h* surround a circle aperture on a discharge space of green. Photo masks 36*h* and 36*i* surround another circle aperture on the discharge space of green. Photo masks 36*j* and 36*l* surround a circle aperture on a discharge space of red. Photo masks 36*j* and 36*k* surround another circle aperture on the discharge space of red. Photo masks 36*k* and 36*m* surround a third circle aperture on the discharge space of red. The area masked by photo masks 36*a*, 36*b*, 36*d*, 36*e*, 36*g*, 36*h*, and 36*i* on the discharge space of green is wider than the area masked by photo masks 36*a*, 36*b*, 36*e*, 36*f*, 36*j*, 36*k*, 36*l*, and 36*m* on the discharge space of red.

In the 26th example, arranging photo masks 36*a* and 36*b* of horizontal beltlike shape, photo masks 36*c*–36*f* of vertical beltlike shape, and photo masks 36*g*–36*m* make an aperture area corresponding to the discharge space of red be wider than an aperture area corresponding to the discharge space of green, and an aperture area corresponding to a discharge space of blue be wider than the aperture area corresponding to the discharge space of red. The 26th example takes the same effects as the first example.

Figure 31:
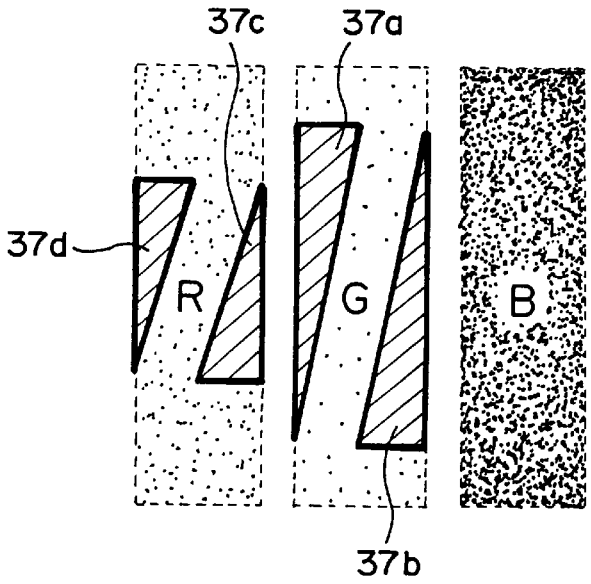
FIG. 31 is a plan view showing a principle structure of the AC surface discharge type of plasma display apparatus according to a 27th example of the present invention.

Referring to FIG. 31 showing the 27th example, no photo mask is disposed on a discharge space of blue. Triangular photo masks 37*a* and 37*b* are disposed on a discharge space of green, and triangular photo masks 37*c* and 37*d* are disposed on a discharge space of red. Photo masks 37*a* and 37*b* are wider than photo masks 37*c* and 37*d* and accordingly, the area masked by photo masks 37*a* and 37*b* on the discharge space of green is wider than the area masked by photo masks 37*c* and 37*d* on the discharge space of red.

In the 27th example, arranging photo masks 37*a*–37*d* makes an aperture area corresponding to the discharge space of red be wider than an aperture area corresponding to the discharge space of green, and an aperture area corresponding to a discharge space of blue be wider than the aperture area corresponding to the discharge space of red. The 27th example takes the same effects as the first example.

Figure 32:
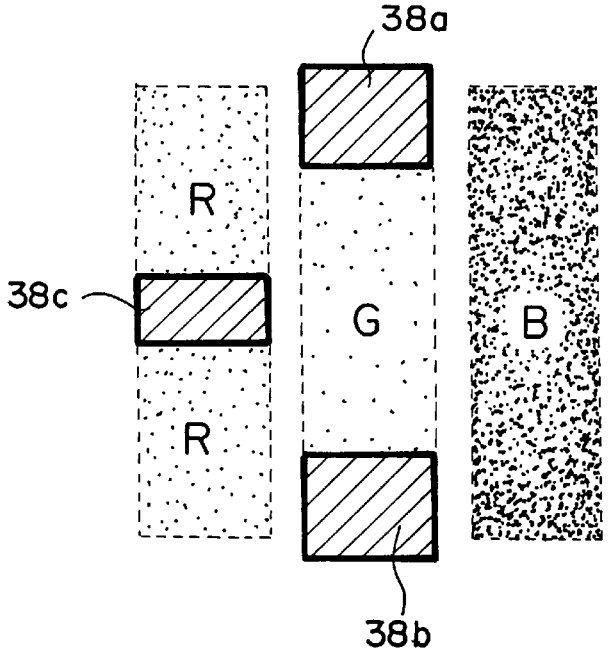
FIG. 32 is a plan view showing a principle structure of the AC surface discharge type of plasma display apparatus according to a 28th example of the present invention.

Referring to FIG. 32 showing the 28th example, no photo mask is disposed on a discharge space of blue. Rectangular photo masks 38*a* and 38*b* are disposed on a discharge space of green, and rectangular photo masks 38*c* is disposed on a discharge space of red. The area masked by photo masks 38*b* and 38*b* on the discharge space of green is wider than the area masked by photo mask 38*c* on the discharge space of red.

In the 28th example, arranging photo masks 38*a*–38*c* makes an aperture area corresponding to the discharge space of red be wider than an aperture area corresponding to the discharge space of green, and an aperture area corresponding to a discharge space of blue be wider than the aperture area corresponding to the discharge space of red. The 28th example takes the same effects as the first example.

Figure 33:
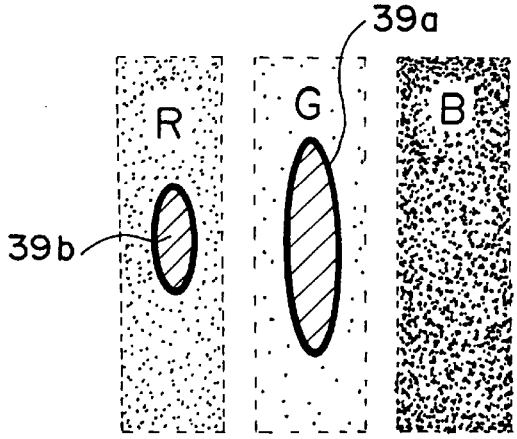
FIG. 33 is a plan view showing a principle structure of the AC surface discharge type of plasma display apparatus according to a 29th example of the present invention.

Referring to FIG. 33 showing the 29th example, no photo mask is disposed on a discharge space of blue. Oval photo mask 39*a* with a major axis in vertical direction is disposed on a discharge space of green, and oval photo mask 39*b* with a major axis in vertical direction is disposed on a discharge space of red. Photo mask 39*a* is wider than photo mask 39*b* in area and accordingly, the area masked by photo mask 39*a* on the discharge space of green is wider than the area masked by photo mask 39*b* on the discharge space of red.

In the 29th example, arranging photo masks 39*a* and 39*b* makes an aperture area corresponding to the discharge space of red be wider than an aperture area corresponding to the discharge space of green, and an aperture area corresponding to a discharge space of blue be wider than the aperture area corresponding to the discharge space of red. The 29th example takes the same effects as the first example.

Figure 34:
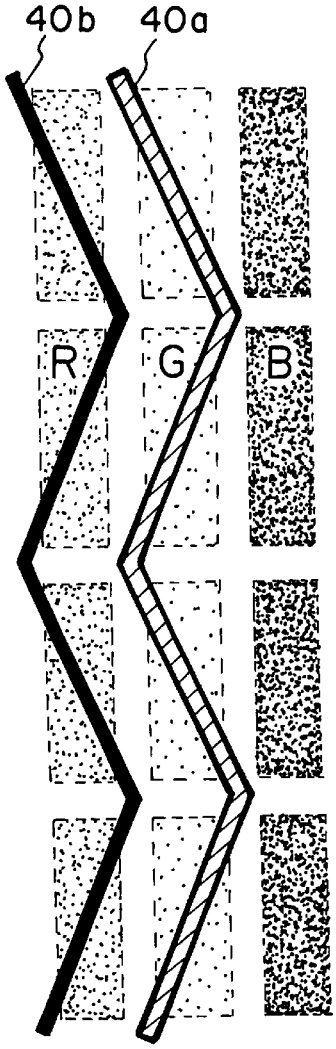
FIG. 34 is a plan view showing a principle structure of the AC surface discharge type of plasma display apparatus according to a 30th example of the present invention.

Referring to FIG. 34 showing the 30th example, no photo mask is disposed on a discharge space corresponding to a pixel of blue. Photo mask 40*a* which diagonally extends from upper right to lower left on each of alternate discharge spaces corresponding to alternate pixels of green and from upper left to lower right on each of the other alternate discharge spaces corresponding to the other alternate pixels of green is disposed across discharge spaces of green arranged in a column. In addition, photo mask 40*b* which diagonally extends from upper right to lower left on each of alternate discharge spaces corresponding to alternate pixels of red and from upper left to lower right on each of the other alternate discharge spaces corresponding to the other alternate pixels of red is disposed across discharge spaces of red arranged in a column. Photo mask 40*a* is wider than photo mask 40*b* in width and accordingly, the area masked by photo mask 40*a* on the discharge space of green is wider than the area masked by photo mask 40*b* on the discharge space of red.

In the 30th example, arranging photo masks 40*a* and 40*b* makes an aperture area corresponding to the discharge space of red be wider than an aperture area corresponding to the discharge space of green, and an aperture area corresponding to a discharge space of blue be wider than the aperture area corresponding to the discharge space of red. The 30th example takes the same effects as the first example.

Figure 35:
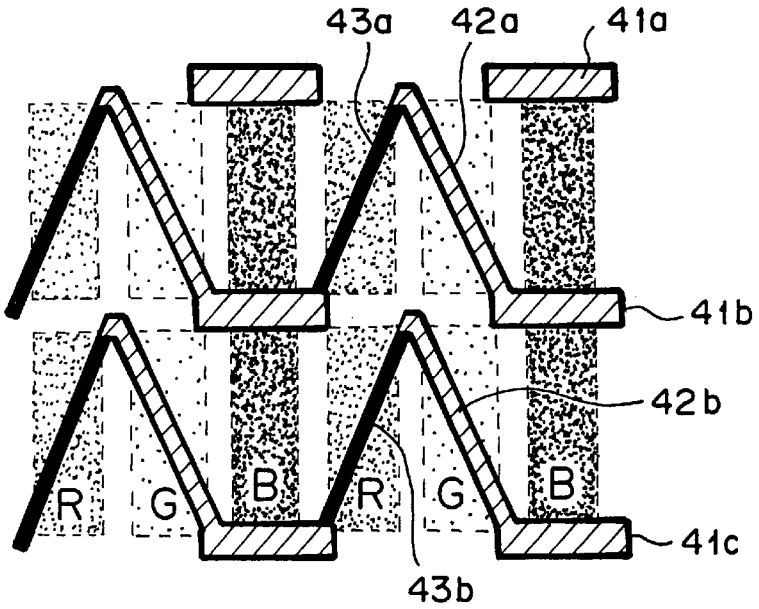
FIG. 35 is a plan view showing a principle structure of the AC surface discharge type of plasma display apparatus according to a 31st example of the present invention.

Referring to FIG. 35 showing the 31st example, each of photo masks 41*a*, 41*b*, and 41*c* is disposed at a boundary between discharge spaces of blue. Each of photo masks 42*a* and 42*b* diagonally extends from upper left to lower right on each of discharge spaces of green. Each of photo masks 43*a* and 43*b* diagonally extends from upper right to lower left on each of discharge spaces of red. Photo masks 41*a*, 41*b*, and 41*c* are wider than photo masks 42*a* and 42*b* in vertical width and photo masks 42*a* and 42*b* are wider than photo masks 43*a* and 43*b* in vertical width. However, Photo masks 42*a* and 42*b* are wider than photo masks 43*a* and 43*b* in effective vertical width and photo masks 43*a* and 43*b* are wider than photo masks 41*a*, 41*b*, and 41*c* in effective vertical width because the intensity of lights at a boundary between discharge spaces is stronger than the intensity of lights at the center of a discharge space. Photo masks 41*b*, 42*a*, and 43*a* are connected together, and photo masks 41*c*, 42*b*, and 43*b* are connected together.

In the 31st example, arranging photo masks 41*a*–41*c*, 42*a*–42*b*, and 43*a*–43*b* makes an effective aperture area corresponding to the discharge space of red be wider than an effective aperture area corresponding to the discharge space of green, and an effective aperture area corresponding to the discharge space of blue be wider than the effective aperture area corresponding to the discharge space of red. The 31st example takes the same effects as the first example.

Figure 36:
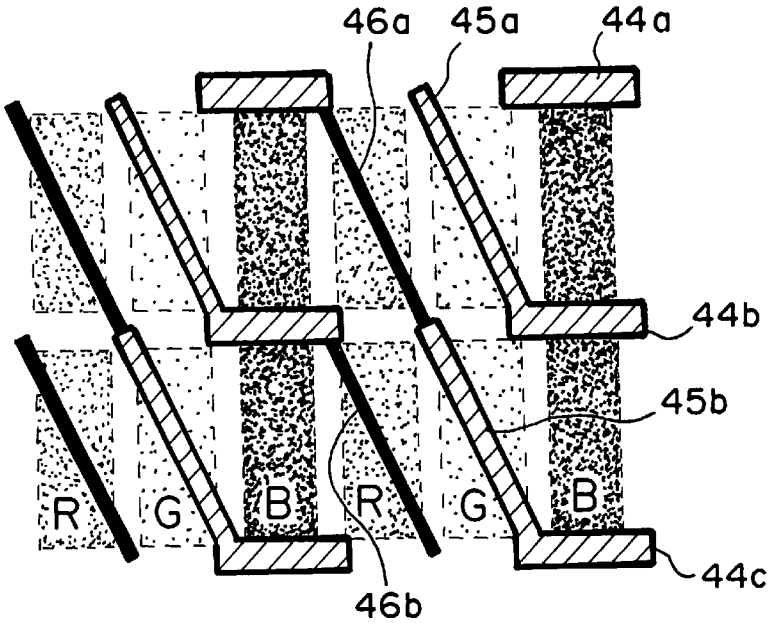
FIG. 36 is a plan view showing a principle structure of the AC surface discharge type of plasma display apparatus according to a 32nd example of the present invention.
Figure 37:
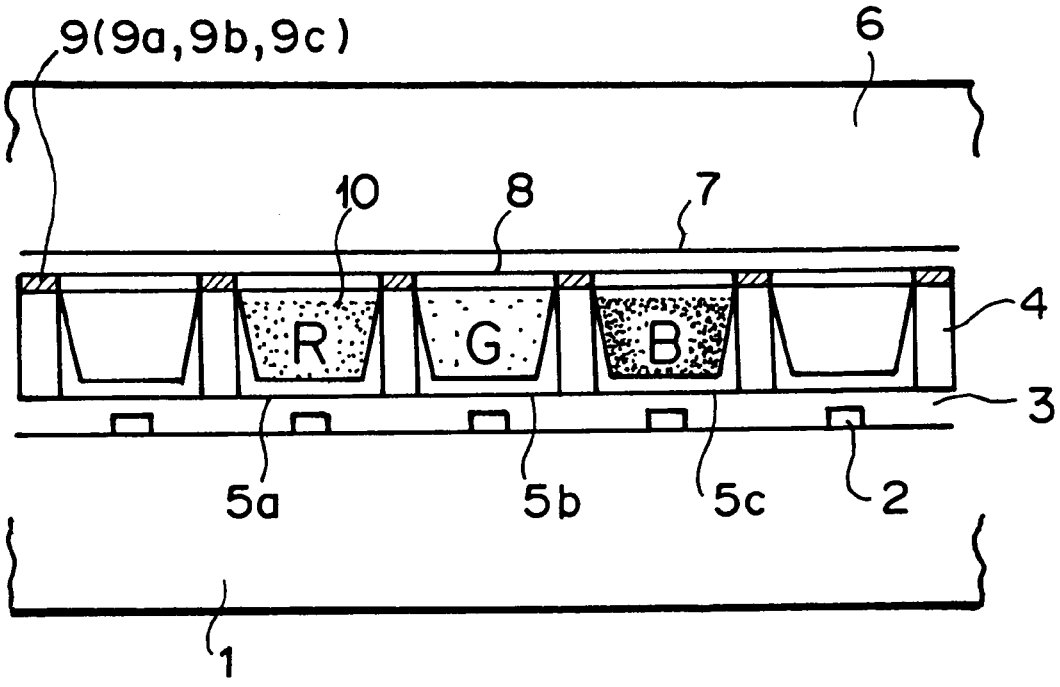
FIG. 37 PRIOR ART
FIG. 37 is a cross sectional view showing a basic structure of a typical conventional AC surface discharge type of plasma display apparatus.
Figure 38:
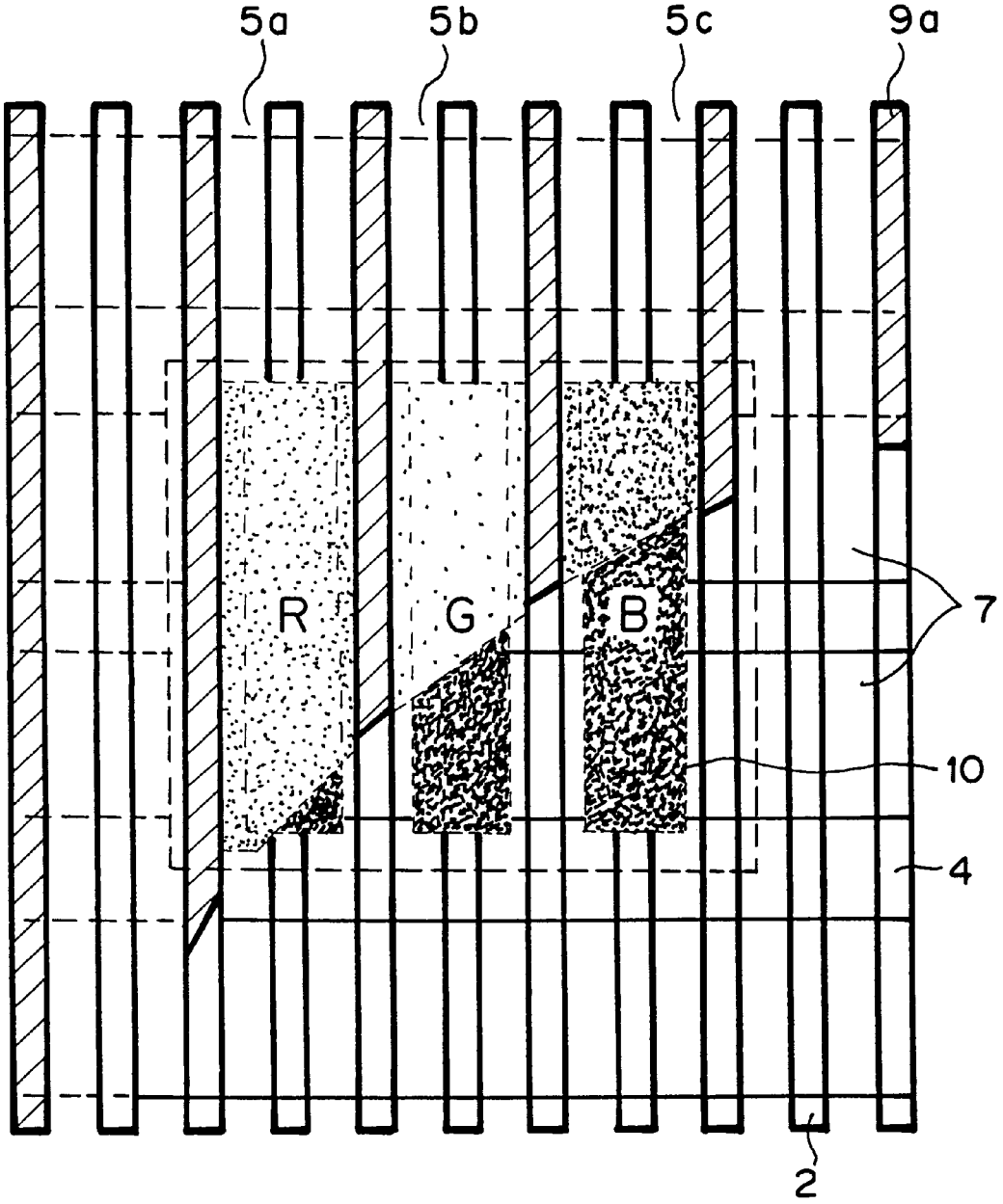
FIG. 38 PRIOR ART
FIG. 38 is a plan view showing a principle structure of the typical conventional AC surface discharge type of plasma display apparatus.
Figure 39:
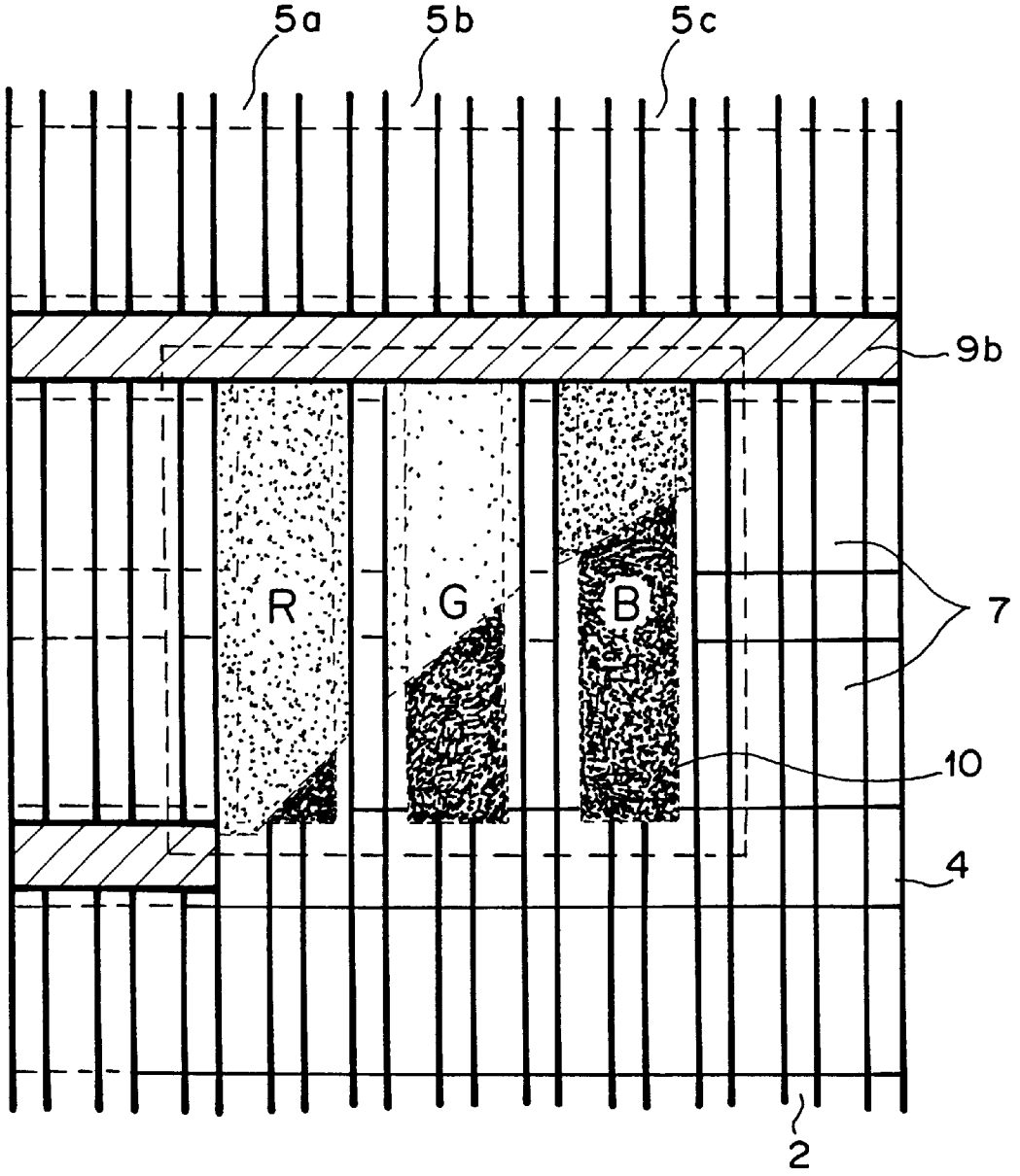
FIG.39 PRIOR ART
FIG. 39 is a plan view showing another principle structure of the typical conventional AC surface discharge type of plasma display apparatus.
Figure 40:
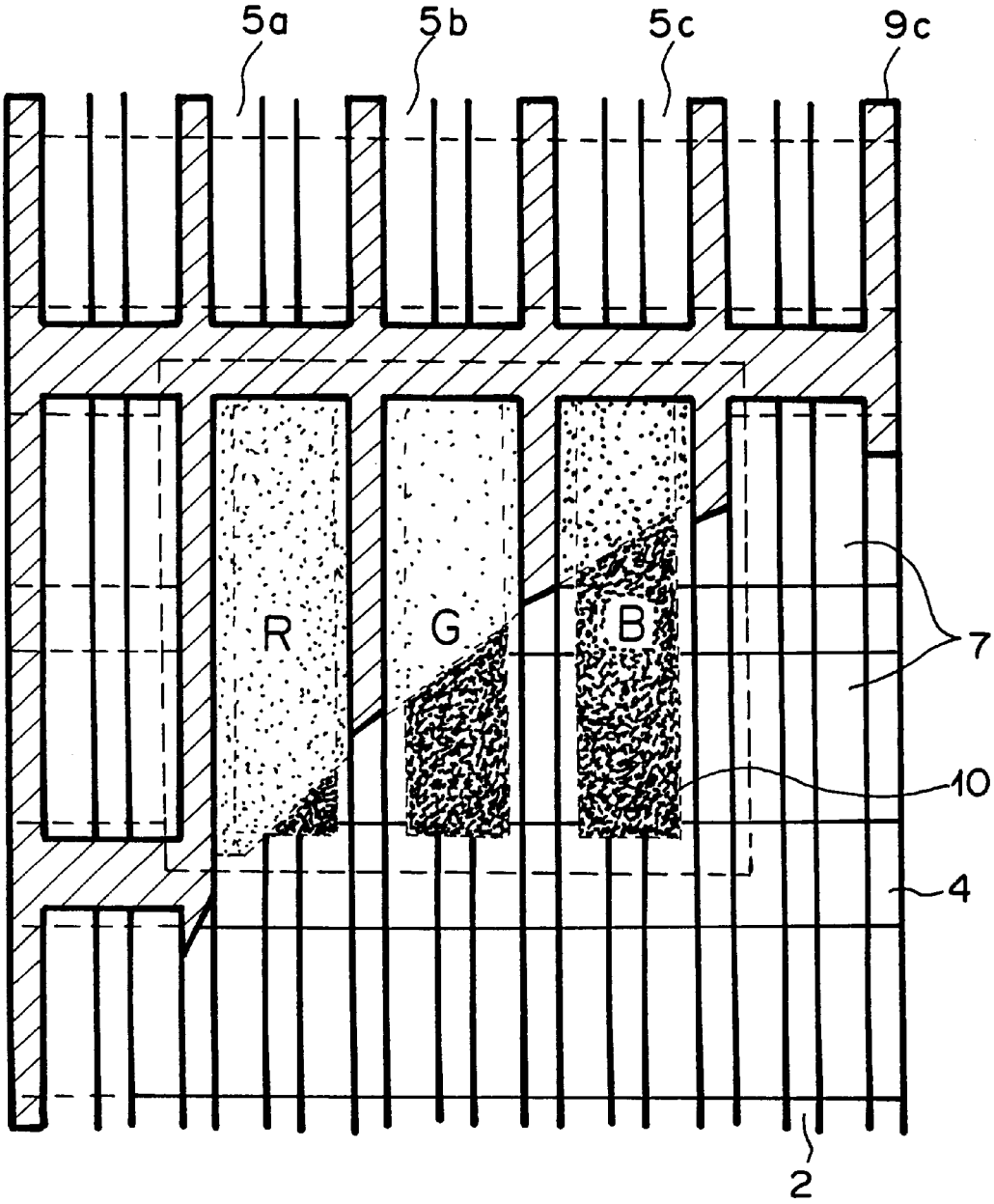
FIG. 40 PRIOR ART
FIG. 40 is a plan view showing a still another principle structure of the typical conventional AC surface discharge type of plasma display apparatus according to a third embodiment of the present invention.

Referring to FIG. 36 showing the 32nd example, each of photo masks 44*a*, 44*b*, and 44*c* is disposed at a boundary between discharge spaces of blue. Each of photo masks 45*a* and 45*b* diagonally extends from upper left to lower right on each of discharge spaces of green. Each of photo masks 46*a* and 46*b* diagonally extends from upper left to lower right on each of discharge spaces of red. Photo masks 44*a*, 44*b*, and

44*c* are wider than photo masks 45*a* and 45*b* in vertical width and photo masks 45*a* and 45*b* are wider than photo masks 46*a* and 46*b* in vertical width. However, Photo masks 45*a* and 45*b* are wider than photo masks 46*a* and 46*b* in effective vertical width and photo masks 46*a* and 46*b* are wider than photo masks 44*a*, 44*b*, and 44*c* in effective vertical width because the intensity of lights at a boundary between discharge spaces is stronger than the intensity of lights at the center of a discharge space. Photo masks 44*b* and 45*a* are connected together, and photo masks 44*c*, 45*b*, and 46*a* are connected together.

In the 32nd example, arranging photo masks 44*a*–44*c*, 45*a*–45*b*, and 46*a*–46*b* makes an effective aperture area corresponding to the discharge space of red be wider than an effective aperture area corresponding to the discharge space of green, and an effective aperture area corresponding to the discharge space of blue be wider than the effective aperture area corresponding to the discharge space of red. The 32nd example takes the same effects as the first example.

Although the present invention has been shown and explained with respect to the best modes of embodiment thereof, it should be understood by those skilled in the art that the foregoing and various other changes, omissions, and additions in the form and detail thereof may be made therein without departing from the spirit and scope of the present invention.

What is claimed is:

1. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks include vertical photo masks, and wherein brightness of said lights varies according to sizes of said apertures, wherein a width of each of vertical photo masks varies in dependence on whether a corresponding discharge space is said discharge spaces of red, said discharge space of green, or said discharge space of blue.

2. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks include vertical photo masks, wherein brightness of said lights varies according to sizes of said apertures, and said vertical photo masks include projections.

3. The plasma display apparatus according to claim 2, wherein said projections are disposed on said discharge spaces of green and said discharge spaces of red, and said projections disposed on said discharge spaces of green are wider than said projections disposed on said discharge space of red in area.

4. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks comprises horizontal photo masks and wherein brightness of said lights varies according to sizes of said apertures.

5. The plasma display apparatus according to claim 4, wherein said horizontal photo masks include projections.

6. The plasma display apparatus according to claim 5, wherein said projections are disposed on said discharge spaces of green and said discharge spaces of red, and said projections disposed on said discharge spaces of green are wider than said projections disposed on said discharge space of red in area.

7. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks comprise vertical photo masks and horizontal photo masks, and brightness of said lights varies according to sizes of said apertures.

8. The plasma display apparatus according to claim 7, wherein a width of each of vertical photo masks varies in dependence on whether a corresponding discharge space is said discharge spaces of red, said discharge space of green, or said discharge space of blue.

9. The plasma display apparatus according to claim 7, wherein said vertical photo masks and said horizontal photo masks are combined with one another.

10. The plasma display apparatus according to claim 7, wherein said vertical photo masks include projections.

11. The plasma display apparatus according to claim 10, wherein said projections are disposed on said discharge spaces of green and said discharge spaces of red, and said projections disposed on said discharge spaces of green are wider than said projections disposed on said discharge space of red in area.

12. The plasma display apparatus according to claim 7, wherein said horizontal photo masks include projections.

13. The plasma display apparatus according to claim 12, wherein said projections are disposed on said discharge spaces of green and said discharge spaces of red, and said projections disposed on said discharge spaces of green are wider than said projections disposed on said discharge space of red in area.

14. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks comprise at least one of: horizontal photo masks, zigzag photo masks and diagonal photo masks, and said photo masks comprise discrete photo masks, and brightness of said lights varies according to sizes of said apertures.

15. The plasma display apparatus according to claim 14, wherein said discrete photo masks are disposed on said discharge spaces of green and said discharge spaces of red, and said discrete photo masks disposed on said discharge spaces of green are wider than said discrete photo masks disposed on said discharge space of red in area.

16. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks comprise zigzag photo masks.

17. The plasma display apparatus according to claim 16, wherein said zigzag photo masks are disposed on said discharge spaces of green and said discharge spaces of red, and said zigzag photo masks disposed on said discharge spaces of green are wider than said zigzag photo masks disposed on said discharge space of red in area.

18. A plasma display apparatus comprising:

discharge spaces of red which emit red light;

discharge spaces of green which emit green light;

discharge spaces of blue which emit blue light; and photo masks which are formed and arranged in order that an aperture of each of said discharge spaces of red is wider than an aperture of each of said discharge spaces of green in area and an aperture of each of said discharge spaces of blue is wider than the aperture of each of said discharge spaces of red in area, wherein said photo masks comprise diagonal photo masks.

19. The plasma display apparatus according to claim 18, wherein said diagonal photo masks are disposed on said discharge spaces of green and said discharge spaces of red, and said diagonal photo masks disposed on said discharge spaces of green are wider than said photo masks disposed on said discharge space of red in area.

* * * * *